US009869463B2

(12) United States Patent
Konishi et al.

(10) Patent No.: US 9,869,463 B2
(45) Date of Patent: Jan. 16, 2018

(54) HEAT SINK FOR LIGHT EMITTING DIODE

(71) Applicant: Kobe Steel, Ltd., Kobe-shi (JP)

(72) Inventors: Haruyuki Konishi, Kobe (JP); Haruyuki Matsuda, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 885 days.

(21) Appl. No.: 14/015,229

(22) Filed: Aug. 30, 2013

(65) Prior Publication Data

US 2014/0126225 A1 May 8, 2014

(30) Foreign Application Priority Data

Nov. 8, 2012 (JP) ..... 2012-246532

(51) Int. Cl.
*F21V 29/89* (2015.01)
*F21V 29/76* (2015.01)
*F21Y 115/10* (2016.01)

(52) U.S. Cl.
CPC ..... *F21V 29/89* (2015.01); *F21V 29/763* (2015.01); *F21Y 2115/10* (2016.08)

(58) Field of Classification Search
CPC ..... F21V 29/89; F21V 29/763; F21V 29/70; F21V 29/503; F21V 29/73; F21V 29/745; H01L 33/642; H01L 33/64
See application file for complete search history.

(56) References Cited

U.S. PATENT DOCUMENTS 3,187,812 A * 6/1965 Staver ..... H01L 23/3672 165/185
3,407,868 A * 10/1968 Coe ..... H01L 23/4093 165/185
4,588,028 A * 5/1986 Marshall ..... H01L 23/3672 165/185
5,844,777 A 12/1998 Gates et al.
7,976,196 B2 * 7/2011 Ivey ..... F21K 9/00 362/218

(Continued)

FOREIGN PATENT DOCUMENTS

JP 10-215094 A 8/1998
JP 2005-16836 1/2005

(Continued)

*Primary Examiner* — Robert May
*Assistant Examiner* — Leah S Macchiarolo
(74) *Attorney, Agent, or Firm* — Oblon, McClelland, Maier & Neustadt, L.L.P.

(57) ABSTRACT

A heat sink includes a base, to which an LED element is attached, and a plate-shaped heat dissipating surface integrally and continuously formed with the base around the LED element. The base and the plate-shaped heat dissipating surface are formed of aluminum or an aluminum alloy having a specific thermal conductivity λ and a specific surface emissivity ϵ. When the plate thickness of the base and the plate-shaped heat dissipating surface is specified in a range from 0.8 to 6 mm, a total projected area of the heat dissipating surfaces of the heat sink is specified in a range from 19000 to 60000 $mm^2$ so as to obtain a heat resistance of 4.0 K/W or smaller. Projected areas of two plate-shaped heat dissipating surfaces of the heat sink in two different directions are sufficiently increased with respect to corresponding sectional areas of the base.

18 Claims, 9 Drawing Sheets

(56) References Cited

U.S. PATENT DOCUMENTS

| | | | | |
|---|---|---|---|---|
| 8,382,320 | B2 * | 2/2013 | Kuegler | F21V 29/20 362/249.02 |
| 2003/0035267 | A1 * | 2/2003 | Searls | G06F 1/20 361/679.54 |
| 2003/0043590 | A1 * | 3/2003 | Walser | B60Q 1/2665 362/494 |
| 2006/0018099 | A1 * | 1/2006 | Chen | F21K 9/00 361/709 |
| 2007/0097692 | A1 | 5/2007 | Suehiro et al. | |
| 2009/0316408 | A1 * | 12/2009 | Villard | F21K 9/00 362/249.13 |
| 2011/0254446 | A1 * | 10/2011 | Tominaga | F21S 48/1159 315/82 |
| 2013/0094187 | A1 | 4/2013 | Kamada | |
| 2013/0201696 | A1 | 8/2013 | Hisayasu et al. | |
| 2014/0020882 | A1 | 1/2014 | Konishi et al. | |

FOREIGN PATENT DOCUMENTS

| | | | |
|---|---|---|---|
| JP | 2007-193960 | | 8/2007 |
| JP | 2008-7558 | | 1/2008 |
| JP | 2008-130232 | | 6/2008 |
| JP | 2009-76377 | | 4/2009 |
| JP | 2009-277535 | | 11/2009 |
| JP | 2010-89573 | A | 4/2010 |
| JP | 2010-278350 | | 12/2010 |
| JP | 2012-44218 | A | 3/2012 |
| JP | 2012-94467 | A | 5/2012 |
| WO | WO 2011/162016 | A1 | 12/2011 |
| WO | WO 2012/128383 | A1 | 9/2012 |

* cited by examiner

HEAT SINK FOR LIGHT EMITTING DIODE

BACKGROUND OF THE INVENTION

1. Field of the Invention

The present invention relates to heat sinks for light emitting diode (LED) lighting and a vehicle LED lamp that includes an LED element as a light source. The heat sink dissipates heat, which is generated when an LED lamp emits light, through radiation to a closed space therearound.

2. Description of the Related Art

Lighting that uses LED elements, which have a long life and feature low power consumption, as its light source has been gradually penetrating to the market. Nowadays, vehicle LED lamps (lighting fixtures for a vehicle and head lights for a vehicle) such as vehicle head lights have been drawing attention in particular among a variety of LED lighting fixtures, and replacement of conventional light source with the LED elements has begun. As application of such vehicle LED lamps (LED lighting), replacement of conventional light in mounted lighting for buildings and other fields of application with the LED lamps has also begun.

However, LED elements as a light source of an LED lamp are significantly vulnerable to heat. For example, when an allowable temperature such as 100° C. is exceeded, luminous efficiency may decrease, and the life of the LED elements may be affected. In order to address this problem, heat generated when the LED element emits light needs to be dissipated to the surrounding space. Thus, an LED lamp is typically equipped with a large heat sink.

In many cases, related-art heat sinks for an LED lamp (LED lighting) use aluminum die-casting products or extruded aluminum products formed of aluminum (including aluminum alloys) (see Japanese Unexamined Patent Application Publications No. 2007-193960, No. 2008-7558, No. 2009-277535, and No. 2010-278350). As illustrated as an example in a perspective view in FIG. 14, these related-art heat sinks are generally include a base portion 30 and fin portions 40. The LED element L (light source) is secured on the front surface side of the base portion 30. A plurality of the fin portions 40 that protrude from the rear side of the base portion 30 are spaced apart from and parallel to one another.

In order to integrate a heat sink for an LED lamp with a vehicle LED lamp (vehicle lighting fixture), a lighting unit (LED lamp unit) is typically disposed in the following structure: a light chamber is defined by a front surface lens and a housing, in which LEDs that serve as a light source is supported (see, for example, Japanese Unexamined Patent Application Publications No. 2008-130232 and No. 2009-76377). Specifically, in an example as illustrated in FIG. 15, such a lighting unit is disposed as follows: that is, in a vehicle LED lighting fixture 51, a light chamber 54 is defined by a front surface lens 52 and a housing 53, and a lighting unit 55 is supported in the light chamber 54.

The lighting unit 55 includes an optical system and a heat dissipating system. The optical system includes an LED element (light source) 56, a mount plate 57, a reflector (reflection plate) 58, a lens holder 59, a shield 60, and a projection lens 61, thereby forming a projector lamp. An LED element 56 circuit board is disposed on the mount plate 57. The reflector 58 is connected to the mount plate 57. The lens holder 59 is connected to the reflector 58. The shield 60 extends upward from an inner bottom surface of the lens holder 59. The projection lens 61 is supported by the lens holder 59.

The heat dissipating system includes the mount plate 57, a heat sink 62, and the reflector 58. The LED element 56 circuit board is disposed on the mount plate 57. The heat sink 62 is secured to the mount plate (base 57). The mount plate 57 and the heat sink 62 are integrated with each other so as to form a heat dissipating member 63, to which the reflector 58 is connected. The base 57, the heat sink 62, and the reflector 58 are formed of one of the following metal materials: Al, an Al alloy, Cu, and a Cu alloy.

In the optical system, when the LED element (light source) 56 is turned on and emits light, light travels from the LED element 56 toward a light reflection surface 64 of the reflector 58 and is reflected by the light reflection surface 64 toward the projection lens 61 at the front. An optical path of part of the light is blocked by the shield 60. The light reflected by the light reflection surface 64 of the reflector 58 and not blocked by the shield 60 is guided through the lens holder 59 and reaches the projection lens 61. The light is distributed in a desired manner by the projection lens 61 and projected toward the front side of the vehicle LED lighting fixture 51 through the front surface lens 52 of the vehicle.

Regarding heat in the heat dissipating system, when the LED element 56 is turned on, light is emitted and heat is generated. Heat generated by the LED element 56 (self-heating) is transferred to the board (not shown), on which the LED element 56 is mounted, conducted through the board, and transferred to the mount plate 57, on which the board is disposed. Then, the heat conducted through the mount plate 57 is transferred to the heat sink 62, which is secured to the mount plate 57. The heat having been transferred to the heat sink 62, conducted through the heat sink 62, and reached the surface of the heat sink 62 is conducted and transferred to air near the surface of the heat sink 62, and radiated to the outside of the heat sink 62 through air as a medium.

SUMMARY OF THE INVENTION

In order to apply such a heat sink by disposing the heat sink in a housing of a head light, tail light, or the like for a vehicle as vehicle lighting, as illustrated in FIG. 15, the heat sink is naturally disposed and used in a small or closed space. In such a small or closed space of the housing for vehicle lighting, a heat dissipating space is also limited to a small space, and a heat dissipating space (volume) around the base portion 30 and the fin portions 40 of the related-art heat sink illustrated in FIG. 14 is decreased. Thus, air convection is mostly inhibited. In such a usage environment, there is little possibility that a heat dissipation effect is caused by air convection, and heat dissipation needs to be performed by radiation.

However, in the related-art heat sink, as described above, the heat dissipation effect is mainly achieved by air convection from heat dissipating surfaces of, for example, the fin portions 40 illustrated in FIG. 14 or the heat sink 62 illustrated in FIG. 15, where the areas of the heat dissipating surfaces are increased, and there is no consideration for heat dissipation performed by radiation. For this reason, naturally with the related-art heat sink, heat dissipation by radiation is not sufficiently performed, and accordingly, heat dissipation cannot be efficiently performed in a small or closed space of the housing for vehicle lighting.

The present invention is proposed in view of the above-described problem, and an object of the present invention is to provide a heat sink for LED lighting, with which efficient heat dissipation by radiation is possible. In other words, the heat sink for LED lighting is provided, with which heat from an LED light source can be efficiently dissipated mainly by radiation even when the heat sink is disposed in a closed space where air convection is almost or completely inhibited.

In order to address the above-described problem, a heat sink for LED lighting according to the present invention includes a base having a front surface and a rear surface, which are heat dissipating surfaces. The front or rear surface of the base serves as a light emitting diode (LED) element attachment surface to which an LED element is attached. The heat sink also includes a plate-shaped heat dissipating surface integrally and continuously formed with the LED attachment surface around the LED element. In the heat sink, the base and the plate-shaped heat dissipating surface are formed of aluminum or an aluminum alloy having a thermal conductivity $\lambda$ of equal to or more than 120 W/(m·K) In the heat sink, a surface emissivity $\epsilon$ of the base and the plate-shaped heat dissipating surface is equal to or more than 0.80. In the heat sink, when a thickness of the base and the plate-shaped heat dissipating surface is specified to be in a range from 0.8 to 6 mm, a total of projected areas of the heat dissipating surfaces of the base and the plate-shaped heat dissipating surface in three planes perpendicular to one another in a three-dimensional space is in a range from 19000 to 60000 $mm^2$. The heat sink for LED lighting is provided, with which heat from the LED light source can be efficiently dissipated mainly by radiation even when the heat sink is disposed in a closed space where air convection is almost or completely inhibited (heat dissipation by air convection is not expected).

According to the present invention, as described above, the thermal conductivity $\lambda$ of the heat sink for LED lighting formed of aluminum or an aluminum alloy and the surface emissivity $\epsilon$ of the heat dissipating surfaces are specified, and then the plate thickness and the total projected area in the three-dimensional space of the heat dissipating surfaces of the heat sink are specified. The reason for this is that, with the heat sink formed of aluminum or an aluminum alloy, the plate thickness and the total of the projected areas (total projected area) of the heat dissipating surfaces in a three-dimensional space significantly affect heat dissipation by radiation. In the present invention, as an index (guideline) for evaluating the property of heat dissipation by radiation, the heat resistance of the heat sink is selected. The heat resistance of the heat sink represents the performance of heat dissipation mainly performed by radiation of the heat sink. As the heat resistance R of the heat sink decreases, the performance of heat dissipation mainly performed by radiation is improved. The heat sink for LED lighting according to the present invention has the plate-shaped heat dissipating surfaces disposed on the side surfaces of the base, to which the LED element is attached, in an integral and continuous manner so that the plate-shaped heat dissipating surfaces extend from the base. In the heat sink, when P denotes the projected area of each of the plate-shaped heat dissipating surfaces projected by the parallel light emitted perpendicular to the plate-shaped heat dissipating surface, and S denotes a corresponding one of the areas of the sections of the base, the sections pass through the position where the LED element is attached and are parallel to a corresponding one of the projected areas, the projected areas of the plate-shaped heat dissipating surfaces in two different directions each satisfy $P \geq 8 \times S$ with respect to a corresponding one of the sections S. Here, the meaning of "the projected areas of the plate-shaped heat dissipating surfaces in two different directions each satisfy $P \geq 8 \times S$" is that, as long as there are the plate-shaped heat dissipating surfaces, being in two different directions, that each satisfy this relationship, there may be another plate-shaped heat dissipating surface that does not satisfy the relationship. Thus, in the heat sink for LED lighting according to the present invention, the projected areas P of the plate-shaped heat dissipating surfaces in two different directions are specified to be a value equal to or greater than a certain value, which is specified in relation with the sectional areas S of the base. In the heat sink having a three-dimensional shape in which the plate-shaped heat dissipating surfaces are integrally and continuously formed on the side surfaces of the base so as to be extend from the base, when the heat sink is used in a closed space such as a vehicle LED lamp, in which air convection is almost or completely inhibited, there is a particular problem, which is produced by a synergistic effect due to the shapes of the heat dissipating surfaces and the three-dimensional shape, in that the projected area of the plate-shaped heat dissipating surfaces significantly affects heat dissipation performed by radiation.

According to the present invention, by specifying the range of plate thickness of the heat sink formed by aluminum or an aluminum alloy and the total projected area of the heat dissipating surfaces, efficiency of heat dissipation mainly performed by radiation can be significantly improved and the heat resistance R of the heat sink can be decreased. Thus, the heat sink for LED lighting, in particular, an LED lighting fixture for a vehicle can be provided, which are formed of a minimized amount of raw material by economically using the aluminum or aluminum alloy. Also, the size and thickness of the heat sink can be reduced, the freedom of design can be increased, and the heat sink can be produced at a reduced cost.

Furthermore, by using the heat resistance R of the heat sink, that is, by specifying the heat resistance R as a specification of the heat sink, a required plate thickness of the base and the plate-shaped heat dissipating surfaces, a required total projected area of the heat dissipating surfaces, and a required surface area of the heat dissipating surfaces can be obtained for the specified heat resistance R. This facilitates the design of the heat sink. Furthermore, the size, the shape, the number and arrangement of the heat dissipating surfaces, and the like of the heat sink, with which efficiency of the heat dissipation mainly performed by radiation is significantly improved, can be easily designed. In other words, a designing method of a heat sink, with which the efficiency of heat dissipation mainly performed by radiation can be significantly improved, can also be provided.

DESCRIPTION OF THE PREFERRED EMBODIMENTS

Figure 1:
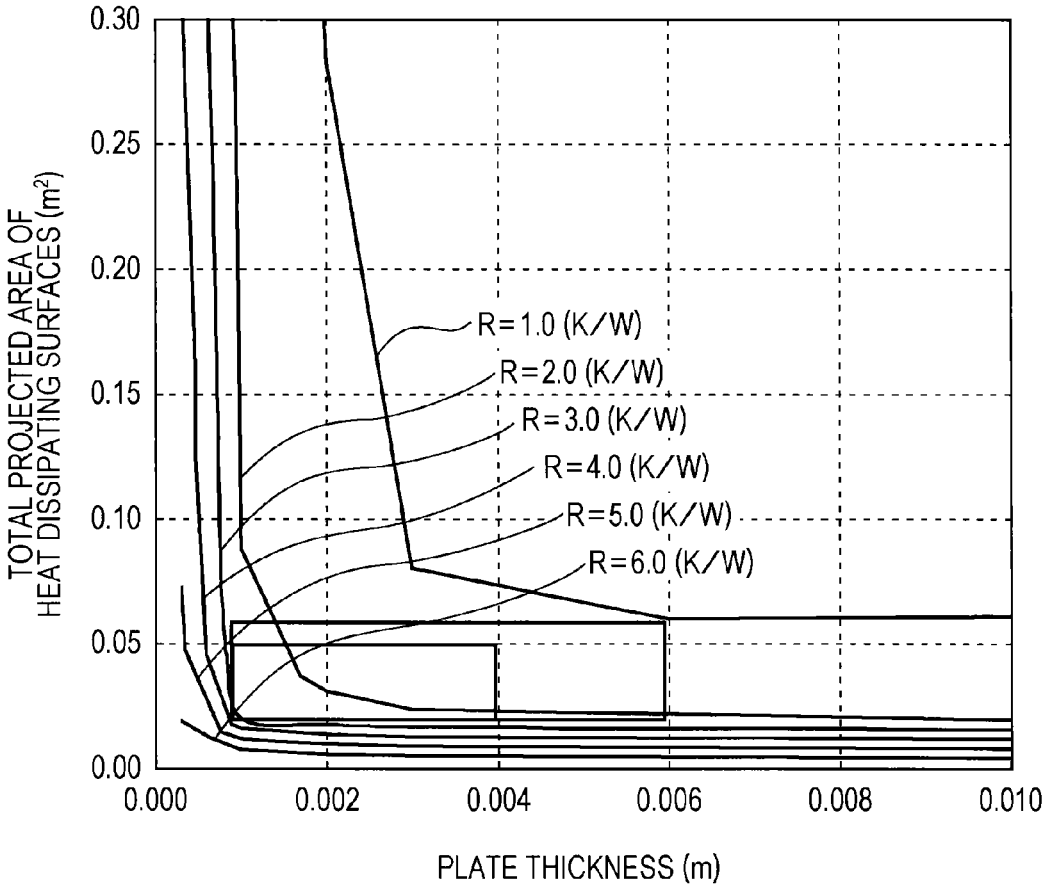
FIG. 1 illustrates the relationships among a heat resistance R, a thickness of a heat sink, and a total projected area of heat dissipating surfaces when the emissivity of the heat dissipating surfaces is 0.8.

Embodiments according to the present invention will be described in detail below with reference to the drawings.

Basic Structure of Heat Sink

Referring to FIGS. 2 to 12, embodiments of a basic structure of a heat sink 1 of the present invention, which is used for effectively dissipating heat from a light emitting diode (LED) light source mainly by radiation, is initially described below.

Referring to FIGS. 2 to 12, the heat sink 1 of the present invention is formed such that plate-shaped heat dissipating surfaces, which include the front and rear surfaces 3 or 4 of the base 2 and examples of which include flat-plate shaped heat dissipating fins 10 to 17, are integrally and continuously formed with a surface to which an LED element 9 attached around the LED element 9. The LED element 9 is attached either the front or rear surface 3 or 4 of the base 2. Here, the heat dissipating surfaces or plate-shaped heat dissipating surfaces (heat dissipating area) of the base 2 and the heat dissipating fins 10 to 17 include not only the front and rear surfaces 3 and 4 of the base 2 and the front and rear surfaces of the heat dissipating surfaces 10 to 17 (area of front and rear surfaces) but also surfaces (surface area) such as plate-thickness-direction side surfaces on four peripheral sides of the base 2 and the plate-thickness-direction surfaces of the heat dissipating fins 10 to 17.

For convenience in the following description, the sign of each flat-plate shaped heat dissipating fin may denote the flat-plate shaped heat dissipating surfaces of the flat-plate shaped heat dissipating fin.

Throughout FIGS. 2 to 12, the flat-plate shaped base 2, to which the LED element is attached, has a quadrangle (rectangular) shape in plan view. The base 2 has two surfaces, that is, the front and rear surface in the Y-direction (up-down direction) in each drawing, and the front and rear surfaces each extend in the X and Z-directions. The flat-plate shaped base 2 supports the LED element 9 attached to either the front or rear surface thereof. For convenience in FIGS. 1 to 7, the surface on the upper side in each drawing is defined as the attachment surface 3 for the LED element 9, which is attached in a central portion of the flat surface. Also for convenience in FIGS. 1 to 7, the other surface on the lower side in each drawing is defined as a rear surface 4.

Furthermore, the front and rear surface 3 and 4 of the base 2 has flat-plate shaped heat dissipating fins 10 to 17. The heat dissipating fins 10 to 17 are each perpendicular to either or both of the front and rear surfaces 3 and 4 (perpendicular to the surface extending directions or X and Z-directions in each drawing) and extends in the Y-direction (up-down direction) in each drawing. Although these flat-plate shaped heat dissipating fins 10 to 17 extend outward from the front and rear surfaces 3 and 4 of the base 2, the heat dissipating fins 10 to 17 are not necessarily perpendicular to, that is at an angle of 90 degrees relative to, the front and rear surfaces 3 and 4 of the base 2 as illustrated in FIGS. 1 to 7. For example, the heat dissipating fins may be extend outward from the front and rear surfaces 3 and 4 of the base 2 so as to be inclined at an angle of more than or less than 90 degrees relative to the front and rear surfaces 3 and 4.

However, in either of the above-described cases, these flat-plate shaped heat dissipating fins 10 to 17 are integrally and continuously formed with the base 2 in terms of material. That is, at least flat-plate shaped front and rear surfaces of the flat-plate shaped heat dissipating fins 10 to 17 and surfaces of the plate-thickness-direction side surfaces on the four peripheral sides are seamlessly continuous with the front and rear surfaces 3 and 4 of the base 2 and surfaces of the side surfaces 5, 6, 7, and 8 on the four peripheral sides of the base 2. That is, heat dissipating surfaces includes the heat dissipating surfaces that face the X-direction, the heat dissipating surfaces that face the Y-direction, and the heat dissipating surfaces that face the Z-direction in the three-dimensional space.

Accordingly, a continuous heat conductive surface is formed, in which heat from the LED element 9 is continuously conducted to the rear surface 4, the surrounding side surfaces and the plate-thickness-direction surfaces of the heat dissipating fins through the LED element attachment surface (front surface) 3 of the base 2. A continuous heat dissipating surface in which heat is continuously radiated from the continuous heat conductive surface is also formed.

FIGS. 2 to 12 illustrated a planar shape or flat surface shape that is rectangular in plan view as an example shape of the base 2. However, in accordance with application of a heat sink for LED lighting, the shape of the base 2 may be adequately selected from among planar shapes in plan view such as a circle, a triangle, a polygon, and an indefinite shape, and a three-dimensional shape such as a cylindrical shape, a square column shape, and a shape having a step, irregularities, a cut, a slit, and the like. Alternatively, the base 2 may be have a generally S, V, or U-curved shape.

Although the LED element 9 is attached (mounted) in the central portion of the front surface 3 of the base 2 throughout FIGS. 2 to 12, the position at which the LED element 9 is attached may desirably selected in accordance with the design.

The flat-plate shaped heat dissipating fins 10 to 17 are perpendicular to the horizontally extending planar surface (flat surface) 3 and 4 of the base 2 at 90 degrees throughout FIGS. 2 to 12. However, the flat-plate shaped heat dissipating fins 10 to 17 are not necessarily perpendicular to or do not necessarily form an identical angle with the planar surfaces (flat surface) 3 and 4 of the base 2, which do not necessarily horizontally extend. That is, the flat-plate shaped heat dissipating fins 10 to 17 may extend so as to form an angle of more than or less than 90 degrees with the planar surfaces 3 and 4 in accordance with the application or design of the heat sink 1.

Thermal Conductivity $\lambda$ of Aluminum

On the assumption of the above-described basic structure, in the present invention, the thermal conductivity $\lambda$ of the heat sink 1 and the surface emissivity $\epsilon$ of each of the heat dissipating surfaces, which are formed of aluminum or an aluminum alloy, are specified in order to improve the efficiency of heat dissipation of the heat sink 1 mainly performed by radiation as described above. That is, the heat conductivities λ of the base 2 and the plate-shaped heat dissipating surfaces 10 to 17, which are part of the heat sink 1, and the surface emissivity ϵ of the heat dissipating surfaces of the base 2 and the plate-shaped heat dissipating surfaces 10 to 17 are defined.

The thermal conductivity λ of the aluminum or the aluminum alloy that forms the heat sink 1 is equal to or greater than 120 W/(m·K), and preferably, equal to or greater than 140 W/(m·K). When the thermal conductivity λ is low, high heat dissipating performance cannot be achieved even with the heat sink 1 that has the above-described structure, in which the continuous heat conductive surface is formed so as to continuously conduct the heat from the LED element 9 to the rear surface 4, the surrounding side surfaces and the plate-thickness-direction surfaces of the heat dissipating fins through the surface (front surface) 3 of the base 2 on the LED element attachment side.

The unit W/(m·K) of the thermal conductivity λ means transfer of one joule of heat per second per square meter cross section when the temperature gradient is one degree per meter. According to the fourth edition of Handbook of Chemistry, the thermal conductivities of typical metals at 27° C. are as follows: Copper: 402, aluminum: 237, stainless steel (Cr 18%, Ni 9%, C 0.05%, Fe: remainder): 15, brass (Cu 70%, Zn 30%): 119.

By forming the heat sink 1 using an aluminum or aluminum alloy wrought material such as a casting material (casting), a cold-rolled sheet (rolled sheet), or an extruded material, the thermal conductivity λ can be equal to or greater than 120 W/(m·K), and preferably, equal to or greater than 140 W/(m·K). In this regard, a die casting aluminum is not suitable because its thermal conductivity λ is, due to its casting properties, about 80 W/(m·K) and the above-described thermal conductivity is not obtained. Regarding the type of aluminum alloy to be used, in order to increase thermal conductivity, pure aluminum having a composition conforming to or equal to the Japanese Industrial Standards (JIS) is preferred. Despite this, although the thermal conductivity is degraded, in order to improve forming or processing properties suitable to make a heat sink, or in order to improve strength and rigidity, one of a variety of aluminum alloys having composition conforming to or equal to JIS may be used. In this case, the characteristic of aluminum alloys in that even a thin aluminum alloy plate has high strength can be utilized.

Surface Emissivity ϵ of Heat Dissipating Surfaces

On the assumption of the basic structure and the thermal conductivity λ as described above, in order to improve efficiency of heat dissipation of the heat sink 1 mainly performed by radiation described above (to obtain high heat dissipation property of the heat sink 1), the surface emissivity ϵ of the heat sink 1, that is, the surface emissivity ϵ of the heat dissipating surfaces of the base 2 and the plate-shaped heat dissipating surfaces 10 to 17 included in the heat sink 1 is preferably high. As the surface emissivity ϵ increases, the heat transfer amount achieved by radiation from a heat sink can be increased. In this regard, the surface emissivity ϵ is equal to or more than 0.65, and preferably, equal to or more than 0.80.

This emissivity ϵ is a ratio of the actual heat emission of an object to a theoretical value (heat emission of a blackbody as an ideal radiator). The surface emissivity may be measured by a method described in Japanese Unexamined Patent Application Publication No. 2002-234460, or by using a commercial portable emissivity measuring device.

When the heat sink 1 according to the present invention is formed of aluminum (pure aluminum) or an aluminum alloy, a comparative low surface emissivity ϵ is obtained. However, in order to obtain a surface emissivity ϵ of equal to or higher than 0.65, or more preferably, obtain equal to or higher than 0.80, a precoating process (paint coating) with a paint having a high heat dissipation ratio such as a black paint, a gray paint, or a white paint may be performed on the heat dissipating surfaces of the base 2 and the plate-shaped heat dissipating surfaces. When this precoating process is performed on a raw-material thin metal plate before a drawing process is performed, the coating functions as lubricant in the drawing process. After a specified shape has been formed, an after-coating process such as electrodeposition or spray coating, or an anodizing process may be performed.

Projected Area

The meaning of a projected area of the heat sink defined in the present invention is described below in relation to a heat resistance R.

FIG. 1 illustrates the relationships among the thickness of the heat sink, the total project area of the heat dissipating surfaces, and the heat resistance R. FIG. 1 is a contour chart illustrating the heat resistance R (measured in experiments) when the surface emissivity of the heat dissipating surfaces of the heat sink is 0.80 in relation to the plate thickness of the heat sink (horizontal axis: in meters) and the total projected area of the heat dissipating surfaces (vertical axis: in $m^2$).

Figure 8:
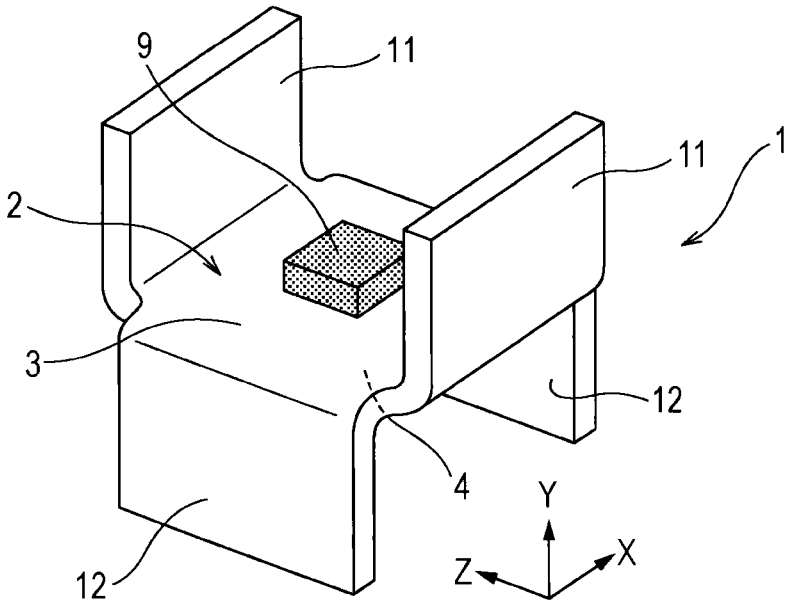
FIG. 8 is a perspective view of another embodiment of the heat sink according to the present invention.

FIG. 1 is an example measured by using samples of the heat sink 1 illustrated in FIG. 8, which will be described later. Among the samples of the heat sink 1 illustrated in FIG. 8, the plate thickness and the total projected area of the heat dissipating surfaces are varied and the LED element 9 is similarly mounted as illustrated in FIG. 8. The difference between the temperature T of the LED element 9 that emits light in the steady state and the ambient temperature T0 is measured, and the difference is divided by power consumption W of the LED (using the aforementioned expression), there by obtaining the heat resistance R of each of the above-described samples of the heat sink 1 to be plotted in the contour chart.

Referring to FIG. 1, the plate thickness of the heat sink 1 illustrated in FIG. 8 is varied in a range from 0.3 mm to 10 mm. Also, the total size (total area) of the heat dissipating surfaces of the front and rear surfaces 3 and 4 of the base 2 and the plate-shaped heat dissipating surfaces 10 and 11 is varied so that the total projected area of the heat sink is in a range from 5000 to 300000 $mm^2$.

As one of the conditions of a temperature measurement experiment of FIG. 1, the aluminum specified in JIS 1050 is used to make the heat sink 1. At this time, the thermal conductivity λ is 231 W/(m·K). The surface emissivity ϵ of the heat sink 1 (base 2 and the plate-shaped heat dissipating surfaces 10 and 11) is measured as follows: the heat sink 1 is coated with a commercial cationic black resin film by performing electrodeposition and then measured by using a commercial portable emissivity measuring device developed by Japan Aerospace Exploration Agency. The result is 0.83 in each of the measured positions. Power consumption of the mounted LED element 9 is 13 W. A test unit that includes the LED and the heat sink is disposed in a wooded box of 300×300×300 mm, which simulates a closed space for a vehicle LED lamp, and a heat dissipating test is performed.

Here, the plate thickness represented by the horizontal axis in FIG. 1 is the plate thickness of the base 2 and the heat dissipating surfaces 10 and 11 of the heat dissipating fins.

The thicknesses of the base 2 and the heat dissipating surfaces 10 and 11 of the heat dissipating fins are set to the same as one another. The total projected area of the heat dissipating surfaces expressed in the vertical axis in FIG. 1 is a total of the areas of the front and rear surfaces 3 and 4 of the base 2 and the four plate-shaped heat dissipating surfaces 11 and 12 projected to planes respectively perpendicular to the X, Y, and Z-axes in FIG. 8 by parallel beams respectively parallel to the X, Y, and Z-axes. That is, the total projected area is a total of the projected areas in three directions facing the X, Y, and Z-directions, which are different from one another.

This area is the total projected area that includes the projected areas of the surfaces of the heat dissipating fins 10 and 11 in the plate thickness direction (upper surface, lower surface, both side end surfaces). Referring to FIG. 8, the side surfaces of the base 2 in the plate thickness direction on the four peripheral sides of the base 2 are integrated with the heat dissipating fins. Thus, the projected area of these side surfaces in the plate thickness direction are included in the projected area of the plate-shaped heat dissipating surfaces of the heat dissipating fins 10 and 11.

Referring to FIG. 1, a lower region surrounded by a square is a region that corresponds to the plate thickness and a range of the total projected area of heat dissipating surfaces of the heat sink 1 specified in the present invention, the range of the total projected area being a range in which the heat resistance R of the heat sink 1 is equal to or less than 4.0 K/W. A region surrounded by a larger square represents a region in which the plate thickness of the heat sink 1 is in a range from 0.8 to 6 mm and the total projected area of the heat dissipating surfaces of the heat sink 1 is in a range from 19000 to 60000 $mm^2$. A region surrounded by a smaller square represents a preferable region in which the plate thickness of the heat sink 1 is in a range from 0.8 to 4.0 mm and the total projected area of the heat dissipating surfaces of the heat sink 1 is in a range from 19000 to 50000 $mm^2$.

The plate thickness of the heat sink 1 and the total projected area of the heat dissipating surfaces of the heat sink 1 are well related to the heat resistance R, which is an index that represents the heat dissipation efficiency of the heat sink. That is, the plate thicknesses of the base 2 and the plate-shaped heat dissipating surfaces (flat-plate shaped heat dissipating fins 10 to 17), which are part of the heat sink 1, and the total projected area of these heat dissipating surfaces are well related to the heat resistance R.

The heat resistance R can be an index (guideline) for evaluating the property of heat dissipation, which is mainly performed by radiation, of the heat sink 1 formed of aluminum or an aluminum alloy. AS the value of the heat resistance R of the heat sink 1 decreases, the efficiency of heat dissipation mainly performed by radiation increases.

Furthermore, when the heat dissipating performance specification (requirement) of a heat sink for an application is defined by the heat resistance R of this heat sink, a required (optimum) plate thickness of the base and the plate-shaped heat dissipating surfaces, a required (optimum) total projected area, a required (optimum) total projected area of the heat dissipating surfaces, and a required surface area of the heat dissipating surfaces can be obtained. This facilitates the design of a heat sink, the weight of which is reduced by, for example, minimizing the amount of aluminum or an aluminum alloy used for the heat sink. This also facilitates a structural design of a heat sink such as the sizes and shapes of the base and plate-shaped heat dissipating surfaces, the number of the plate-shaped heat dissipating surfaces, and arrangement of the plate-shaped heat dissipating surfaces around the base and LED element so as to significantly improve the efficiency of heat dissipating mainly performed by radiation in a closed space such as a vehicle LED lamp, in which air convection is almost inhibited. In other words, a method of designing a heat sink, with which the efficiency of heat dissipation mainly performed by radiation in a closed space such as a vehicle LED lamp is significantly improved, can also be provided.

According to the present invention, a range of the plate thickness and the total projected area of the heat dissipating surfaces of the heat sink 1 (base 2 and plate-shaped heat dissipating surfaces 10 to 17) formed of aluminum or an aluminum alloy is determined so as to decrease the heat resistance R of the heat sink 1, specifically, set the heat resistance R to equal to or less than 4.0 K/W in FIG. 1, thereby significantly improving the efficiency of heat dissipation mainly performed by radiation.

However, the region of the present invention, the region being surrounded by the square in FIG. 1, indicates that it is difficult to decrease the heat resistance R to a value less than 1.0 K/W. The reason for this is physical limits of aluminum or an aluminum alloy and structural limits in providing the heat dissipating surfaces of the heat sink which needs to be disposed inside a limited space such as a head lamp of an automobile. Thus, a practical lower limit of the heat resistance R of the heat sink 1 formed of aluminum or an aluminum alloy is 1.0 K/W. Accordingly, a preferable range of the heat resistance R of the heat sink 1 is from 1.0 K/W to 4.0 K/W.

Referring to FIG. 1, when the heat resistance R of the heat sink 1 exceeds 4.0 K/W and is increased to, for example, 5.0 K/W and 6.0 K/W, the LED is not preferably cooled by the heat sink 1, and accordingly, the intensity and the life of the element may decrease. Furthermore, a heat sink, the weight of which is reduced by economical use of the material and an economical design of the structure, cannot be provided.

Total Projected Area

According to the present invention, the efficiency of heat dissipation mainly performed by radiation is improved so as to set the heat resistance R of the heat sink 1 to equal to or less than 4.0 K/W on the assumption of the basic structure of the heat sink 1 and the thermal conductivity $\lambda$ mentioned above and the plate thickness, which will be described later. In order to do this, as the total of projected areas of three planes perpendicular to one another in the three-dimensional space of the heat sink, the total of projected areas (total projected area) are specified by projecting the flat surfaces of the heat sink perpendicular to the X, Y, and Z-axes by parallel beams respectively parallel to the X, Y, and Z-axes. The total projected area is specified to be equal to or more than 19000 $mm^2$.

Here, the projected area of the heat dissipating surface is a projected area projected by, as described above, a parallel beam emitted in a direction perpendicular to each of the heat dissipating surfaces. The projected area defined in the present invention becomes a heat dissipating area in the case where the heat dissipating surfaces most efficiently perform radiant heat transfer and is preferable as an index that most adequately expresses effects (influences) of the heat dissipating area of the heat dissipating surfaces.

As illustrated in FIG. 1, as the total projected area of the heat sink increases, the efficiency of the heat dissipation mainly performed by radiation increases and the heat resistance R decreases. The reason for this is that the total projected area of the heat sink as a size effect affects the heat dissipation property by radiation and significantly affects the heat resistance of the heat sink 1 according to the present invention. As the total projected area of the heat dissipating surfaces of the base and the plate-shaped heat dissipating surfaces increases, the efficiency of the heat dissipation mainly performed by radiation increases and the heat resistance R of the heat sink decreases.

Thus, as long as the heat sink 1 has a structure having the continuous heat conductive surface in which heat from the LED element 9 is continuously conducted to the rear surface 4 and the surrounding side surfaces and plate-thickness-direction surfaces of the heat dissipating fins through the surface (front surface) 3 of the base 2 on the LED element attachment side, the heat conduction amount should become larger as the total projected area (sizes) of the base and the heat dissipating surfaces of the plate-shaped heat dissipating surfaces increases.

The total of projected areas (total projected area) of the heat sink 1 projected onto the three planes perpendicular to one another in the three-dimensional space refer to not only the projected areas described with reference to FIG. 8 but also refer to the total of the projected areas obtained by projecting the heat sink 1 having the front and rear surfaces 3 and 4 of the base 2, which are illustrated in FIGS. 2 to 10 and will be described later, and the heat dissipating surfaces of the heat dissipating fins 10 to 17 onto planes respectively perpendicular to the X, Y, and Z-axes in FIGS. 2 to 10 by parallel light beams respectively parallel to the X, Y, and Z-axes. That is, the total of the projected areas is a total of the projected areas in three directions facing the X, Y, and Z-directions of the heat sink 1, the directions being different from one another.

This includes the total projected area of the side surfaces 5, 6, 7, and 8 (in the drawings, 5 is on the left side, 6 is on the lower side, 7 is on the right side, and 8 is on the upper side) in the plate thickness direction of the base 2 on the peripheral sides of the base 2 because these are also heat radiating surfaces. Likewise, the total projected area of the plate-thickness-direction surfaces of the heat dissipating fins 10 and 11 on the upper side and both end side are included in the specified total projected area since the upper surfaces and the both end surfaces also serve as heat radiating surfaces.

Due to the above-described definition, the specified total projected area is the projected area of the heat sink 1, which is the total of the projected areas of the base 2 and the plate-shaped heat dissipating surfaces 10 to 17 independently of the area (not excluding but including the area) used to attach (mount) the LED element 9.

When the total projected area of the heat dissipating surfaces is excessively small, the efficiency of heat dissipation mainly performed by radiation cannot be increased and the heat resistance R becomes excessively large. However, there naturally is an upper limits in size for applications such as a vehicle LED lamp because there is a demand for reduction in weight of such applications and the installation space for such an application is limited. In addition, it is also important that, as the size is increased, the weight is also increased, thereby inhibiting a decrease in weight.

Thus, the total projected area of the heat dissipating surfaces of the base and the plate-shaped heat dissipating fins is specified to be equal to or less than 60000 $mm^2$ and preferably specified to be equal to or less than 50000 $mm^2$, and with the above described lower limit of 19000 $mm^2$, the total projected area of the base and the plate-shaped heat dissipating fins is specified to be in a range from 19000 to 60000 $mm^2$, and is preferably specified to be in a range from 19000 to 50000 $mm^2$.

Heat Resistance R

The heat resistance R referred in the present invention is a value given by (T−T0)/W, that is, the difference ΔT (that is, T−T0) between the temperature T of the LED element 9 being turned in the steady state and the ambient temperature T0 divided by power consumption W of the LED element 9. As described above with reference to FIG. 1, these temperatures are obtained by actual measurement. The heat resistance originally defined in the field of heat transfer engineering is given by (T−T0)/Q, that is, the difference ΔT=(T−T0) between the temperature T of a heat source and the ambient temperature T0 divided by the calorific value Q of the heat source. Strictly, the calorific value Q of the heat source is different from power consumption W of LED. However, luminous efficiency of a typical LED is equal to or less than 10% and most of electrical energy is converted into heat. Thus, the above-described definition is used.

Here, in the heat sink 1, it is clear that the temperature T of the LED element 9 in the steady state, that is, the LED element 9 is operated or used in a steady lighting state, is higher than the temperature of portions around the LED element 9. Regarding the temperatures of the portions around the LED element 9, when the temperature T of the LED element 9 in the steady state is determined (recognized) by the measurement or in accordance with track records, the temperature distribution is such that the temperature is substantially concentrically conducted and the conducted temperature is substantially concentrically decreased toward the front and rear surfaces of the base 2 and the heat dissipating surfaces of the heat dissipating surfaces 10 to 17 around the LED element 9 at the center in the heat sink 1 and the like illustrated in FIG. 3 for the case illustrated in FIG. 1.

Plate Thickness of Base and Heat Dissipating Fin

On the assumption that the heat sink has the structure and thermal conductivity λ as described above, in order to improve the efficiency of heat dissipation of the heat sink mainly performed by radiation and obtain a heat resistance R of equal to or less than 4.0 K/W with the projected area in a range specified above, the thickness of the base 2 and the heat dissipating fins 10 to 17 is specified to be in a range from 0.8 to 6.0 mm, and is preferably specified to be in a range from 0.8 to 4.0 mm.

As illustrated in FIG. 1, as the plate thickness increases (becomes thicker), the heat resistance R decreases and the efficiency of heat dissipation mainly performed by radiation increases. The reason of this is that, as the plate thickness increases, the heat conduction amount increases. Thus, as long as the heat sink 1 has a structure having the continuous heat conductive surface in which heat from the LED element 9 is continuously conducted to the rear surface 4 and the surrounding side surfaces and plate-thickness-direction surfaces of the heat dissipating fins through the surface (front surface) 3 of the base 2 on the LED element attachment side, the thermal conductivity should become larger as the size of the base and the heat dissipating surfaces, which can be used, increases.

According to FIG. 1, it is supported that, in order to obtain a heat resistance R of equal to or less than 4.0 K/W and increase the efficiency of heat dissipation mainly performed by radiation, the thickness of the base and the plate-shaped heat dissipating surfaces is specified to be equal to or more than 0.8 mm. When the plate thickness is excessively small (excessively thin), the heat dissipation mainly performed by radiation is not sufficiently performed and the heat resistance R becomes excessively high.

However, there naturally are upper limits in size and plate thickness for applications such as a vehicle LED lamp because there is a demand for reduction in weight of such applications and the installation space for such an application is limited. Thus, the plate thickness of the base and the plate-shaped heat dissipating surfaces is specified to be equal to or less than 6 mm and preferably specified to be equal to or less than 4.0 mm, and with the above described lower limit, the plate thickness of the base and the plate-shaped heat dissipating surfaces is specified to be in a range from 0.7 to 6 mm, and is preferably specified to be in a range from 0.8 to 4.0 mm.

The plate thickness of the base and the plate thicknesses of the heat dissipating fins may be the same as one another or may be changed and different from one another as long as they are within the above-described specifications or preferable range.

Embodiment of Heat Dissipating Fins

In order to achieve the performance of the heat sink of the present invention as described above, there are embodiments of the structure (arrangement) of the flat-plate shaped heat dissipating fins 10 to 17 as the plate-shaped heat dissipating surfaces. A variety of these embodiments will be described below with reference to FIGS. 2 to 12. In the heat sinks 1 illustrated in FIGS. 2 to 12, there are design ideas for the structure and arrangement of the heat dissipating fins in order to perform heat dissipation mainly by radiation, which is required in a small or closed space of a housing of a vehicle lighting, and improve the efficiency of heat dissipation performed by radiation.

First, on the assumption that each of the heat sinks 1 illustrated in FIGS. 2 to 12 has the above-described basic structure, the heat sinks 1 have two to eight of the flat-plate shaped heat dissipating fins 10 to 17 disposed preferably on two surfaces 3 and 4 of the base 2 so as to be continuous and integral with the surfaces 3 and 4 of the base 2 and spaced apart from one another. The shapes of these structures can be produced by, for example, machining an extruded rod, bending a rolled plate, casting, or another method from a raw-material aluminum.

Out of the heat dissipating fins 10 to 17, the number of fins that extend so as to face the same direction, which include fins that extend parallel to one another, is specified to be equal to or less than two in an arbitrary section that perpendicularly intersects two surfaces 3 and 4 of the base 2. That is, the number of fins is specified to be equal to or less than two in any section of the heat sink 1 taken in an arbitrary section in a direction that perpendicularly intersects two surfaces 3 and 4 of the base 2.

Meaning of Specification of Heat Dissipating Fin Extending Direction

Figure 14:
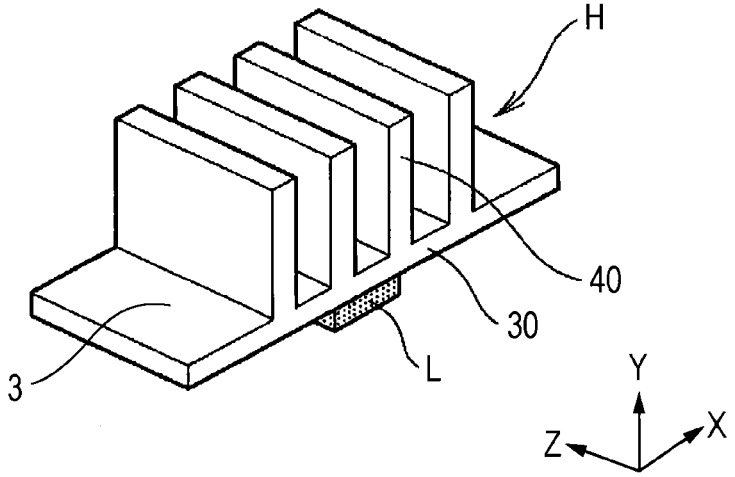
FIG. 14 is a perspective view of an embodiment of a related-art heat sink.

Here, in the present invention, a state in which the heat dissipating fins extend so as to face the same direction may include not only a state in which the heat dissipating fins extend strictly parallel to each other but also a state in which angles of directions in which the flat-plate shaped side surfaces of the heat dissipating fins extend are slightly different from each other. An object of the present invention is to achieve high heat radiation efficiency with economical use of the material by eliminating a situation in which the heat dissipating fins are excessively superposed with one another in any of the three-dimensional directions of the heat sink. Thus, as long as this object and the effects are not obstructed, even when the angles of directions in which the flat-plate shaped side surfaces of the heat dissipating fins extend are slightly different from each other, this can be regarded as a state in which the flat-plate shaped side surfaces extend so as to face the same direction. Whether the angles of the directions in which the flat-plate shaped side surfaces of the heat dissipating fins extend are slightly different from each other or the flat-plate shaped side surfaces of the heat dissipating fins are strictly parallel to each other and these angles are the same as each other, there is no significant difference in terms of the structure, in which the heat dissipating fins are oriented in the same direction and superposed with each other as illustrated in FIG. 14, to be restricted by the present invention.

As a guideline for the difference in the angles, when the angle formed by the directions in which the flat-plate shaped side surfaces of the heat dissipating fins extend is equal to or smaller than 30 degrees, the heat dissipating fins are regarded as the heat dissipating fins that extend so as to face the same direction. However, when the angle formed by the directions in which the flat-plate shaped side surfaces of the heat dissipating fins extend is larger than 30 degrees, the heat dissipating fins are not regarded as the heat dissipating fins that extend so as to face the same direction.

Referring to FIGS. 2 to 7, which will be described later, the LED element 9 are interposed between two heat dissipating fins, which extend parallel to each other as an embodiment in which the heat dissipating fins extend so as to face the same direction. The heat dissipating fins form a rectangular shape so as to surround four peripheral sides of the LED element 9 and the heat dissipating fins adjacent to each other are perpendicular to each other (intersect each other at a right angle with each other). According to the present invention, the heat dissipating fins are not necessarily arranged as described above. The heat dissipating fins may be spaced apart such that the heat dissipating fins surround an area around the LED element 9 along a circle or an arc centered at the LED element 9 with the angles of the respective flat-plate shaped side surfaces gradually changed like, for example, falling dominoes.

The number of heat dissipating fins that extend so as to face the same direction is specified to be equal to or less than two in an arbitrary section that perpendicularly intersects two surfaces 3 and 4 of the base 2 (in any section of the heat sink taken in this direction). The reason for this is that a situation in which the heat dissipating fins are excessively superposed with one another in a direction in the three-dimensional space is prevented. As will be described later, a single heat dissipating fin may have a plurality of flat-plate shaped heat dissipating surfaces (heat dissipating side surfaces) that extend in the respective directions different from one another so as to have an L-shape or U-shape. The number of heat dissipating fins (how the heat dissipating fins are superposed with one another) in the same direction is checked not only for the flat-plate shaped heat dissipating fins but also for these heat dissipating fins that each have plurality of heat dissipating surfaces that have different shapes or extend in different directions by regarding the each linear part of, for example, the L-shape or U-shape in plan view as a single heat dissipating fin. By the above-described checking, in an arbitrary section that perpendicularly intersects the front or rear surface of the base, the number of heat dissipating fins extending in the same direction is specified to be equal to or less than two. Thus, a situation in which the heat dissipating fins or the heat dissipating side surfaces of the heat dissipating fins oppose each other and are superposed with each other can be avoided. That is, in the above-described specification, whether the heat dissipating surfaces belong to a single fin or not, the number of the heat dissipating surfaces (heat dissipating side surface) of the heat dissipating fin is regarded as the number of fins, a situation in which the fins are excessively superposed with each other is avoided wherever the fins are disposed on the surfaces 3 and 4 of the base 2. By doing this, the above-described specification regarding the number of superposed fins is satisfied.

In this regard, if the number of the heat dissipating fins that extend so as to face the same direction is defined as "equal to or less than two in both the surfaces 3 and 4 of the base 2", which is a wording different from that of the above-described specification, this defines the absolute number of the heat dissipating fins. In this case, the individual heat dissipating surfaces of an L-shaped or U-shaped heat dissipating fin, the heat dissipating surfaces extending in different directions, are not regarded as fins in counting the number of fins. Accordingly, the heat dissipating surfaces may be excessively superposed with one another depending on the positions of two surfaces 3 and 4 of the base 2. Thus, the number of fins is specified to be equal to or less than two in an arbitrary section that perpendicularly intersects two surfaces 3 and 4 of the base 2 (in any section of the heat sink taken in this direction).

The entire shapes and the flat-plate shaped side surfaces of the flat-plate shaped heat dissipating fins 10 to 17 illustrated as examples in FIGS. 2 to 12 are rectangular (quadrangle). However, the shapes of the heat dissipating fins are not limited to these. The heat dissipating fins may have a non-rectangular planar shape or three-dimensional shape. For example, as examples of arrangement of a plurality of flat-plate shaped heat dissipating surfaces (heat dissipating side surfaces) extending in different directions (for example, 90 degrees or larger), the heat dissipating fins 10 and 11, which are adjacent to each other, or 12 and 13, which are adjacent to each other, may be arranged so as to form an L shape, or the heat dissipating fins 10, 11, and 10, which are adjacent to one another, or 12, 13, and 12, which are adjacent to one another, may be arranged so as to form a U shape. The heat dissipating fin does not necessarily have the flat-plate shaped heat dissipating surface (heat dissipating side surface). In the case where manufacture is possible, the heat dissipating fin may have an arc-shaped or curved heat dissipating surface (heat dissipating side surface), or the entire shape of the heat dissipating fin may be arc-shaped or curved. The shape or the thickness of a section in the plate-thickness direction, the section extending outward, may be varied in the height direction so as to have an L-shape or a step shape. Furthermore, the surface shape of the heat dissipating surface may be adequately selected from among a circle, triangle, polygon, indefinite shape, and the like.

FIG. 2

Figure 2:
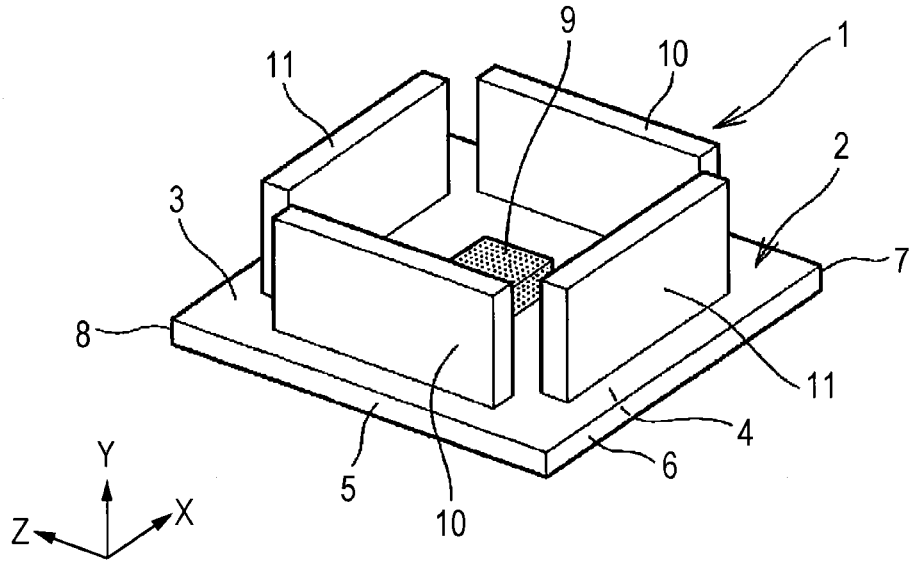
FIG. 2 is a perspective view of an embodiment of a heat sink according to the present invention.

Referring to FIG. 2, total four of the flat-plate shaped heat dissipating fins 10 and 11 are disposed on the LED element attachment surface 3 side, where the LED element 9 is supported, of the base 2 such that the flat-plate shaped side surfaces of the heat dissipating fins 10 and 11 are integral and continuous with the surface 3 of the base 2. The heat dissipating fins are not disposed on the other side, which is on the rear surface 4 side, where only the flat-plate shaped rear surface 4 exists. The length (width) by which each of these heat dissipating fins 10 and 11 extends on the base 2 is shorter than the length (width) of corresponding one of the sides (side surfaces) 5, 6, 7, and 8 of the rectangular base 2.

The heat dissipating fins 10 and 11 are disposed on the LED element attachment surface 3 side such that the LED element 9 is interposed between symmetrically arranged two heat dissipating fins 10 and between symmetrically arranged two heat dissipating fins 11. As embodiments of the fins that extend so as to face the same direction, the heat dissipating fins 10 on the left and right sides in FIG. 2 are parallel to each other, and the heat dissipating fins 11 on the upper and lower sides in FIG. 2 are parallel to each other. That is, the flat-plate shaped heat dissipating fins 10, which oppose each other, and the flat-plate shaped heat dissipating fins 11, which oppose each other, are formed on the front surface side, the front surface serving as the LED element attachment surface 3. The heat dissipating fins 10 and 11 are positioned such that the LED element 9 is interposed between the heat dissipating fins 10 and between the heat dissipating fins 11. Regarding the heat dissipating fins 10 and 11, the number of heat dissipating fins that extend so as to face the same direction is specified to be two in an arbitrary section that perpendicularly intersects two surfaces 3 and 4 of the base 2 (in any section of the heat sink 1 taken in this direction).

The heat dissipating fins 10 and 11 are formed and arranged so as to surround the rectangular four peripheral sides that surrounds the LED element 9 (located around the LED element 9). The heat dissipating fins adjacent to each other are perpendicular to each other (intersect each other at a right angle with each other), and the flat-plate shaped side surfaces of the heat dissipating fins 10 and 11 having a high emissivity each face the X or Z-direction. Also in the base 2, the LED element attachment surface 3 and the rear surface 4 having a high emissivity face the Y-direction.

Furthermore, the plate-thickness-direction (thickness) side surfaces 5, 6, 7, and 8 (5 on the left side, 6 on the lower side, 7 on the right side, and 8 on the upper side in FIG. 2) on the four peripheral sides of the base 2 each face the X or Z-directions and each serve as a heat radiating surface in the corresponding direction although the areas thereof are small compared to the above-described surfaces. This is also true for the plate-thickness-direction (thickness) surfaces (upper and both end surfaces) of the heat dissipating fins 10 and 11, the areas of which are small and the number of which is large compared to those of the flat-plate shaped side surfaces. Out of the upper and the end surfaces of the heat dissipating fins 10 and 11, four surfaces face the X-direction, four surfaces face the Y-direction, and four surfaces face the Z-direction, and these upper and end surfaces serve as heat radiating surfaces in the respective the directions. That is, not only the flat-plate shaped heat dissipating surfaces on the front and rear surfaces of the base and heat dissipating fins but also the plate-thickness-direction heat dissipating surfaces of the base and the heat dissipating fins have heat dissipating surfaces that include surfaces that face the X-direction, surfaces that face the Y-direction, and surfaces that face the Z-direction in the three-dimensional space.

Accordingly, among the flat-plate shaped side surfaces of the heat dissipating fins 10 and 11, the radiating surfaces are superposed with each other in each pair of surfaces opposing each other on the LED element attachment side. However, the heat dissipating surfaces of the heat dissipating fins are not excessively superposed with one another in each of the X, Y, and Z three-dimensional directions. Thus, the material is economically used. Accordingly, as described above, the continuous heat conductive surface is formed, in which heat from the LED element 9 is continuously conducted to the rear surface 4, the side surfaces at the peripheries of the heat dissipating fins and the plate-thickness-direction surfaces of the heat dissipating fins through the attachment surface 3 of the base 2. A high heat radiation efficiency is achieved by a synergistic effect with an effect produced by forming a continuous heat dissipating surface that continuously radiates heat from the continuous heat conductive surface.

Number of Heat Dissipating Fins

The number of heat dissipating fins that extend so as to face the same direction is further decreased by removing the heat dissipating fins other than two heat dissipating fins, which are one of the heat dissipating fins 10 on the left and right sides in FIG. 2 and one of the heat dissipating fins 11 on the upper and lower sides in FIG. 2, or either of two heat dissipating fins 10 and two heat dissipating fins 11 in the case where only two heat dissipating fins are provided in an arbitrary section that perpendicularly intersects the surfaces 3 and 4 of the base 2. In this case, two heat dissipating fins that remain may be the heat dissipating fins 10 on the left and right sides in FIG. 2, the heat dissipating fins 11 on the upper and lower sides in FIG. 2, or one of the heat dissipating fins 10 and one of the heat dissipating fins 11.

In contrast, in the case where the number of the flat-plate shaped heat dissipating fins are increased, the heat dissipating surfaces of the heat dissipating fins are superposed with one another in one of the three-dimensional directions X, Y, and Z. Thus, the unnecessary material is used and heat radiation efficiency (heat dissipation efficiency) is decreased for a large occupied space. Accordingly, the total number of heat dissipating fins provided on two surfaces 3 and 4 of the base 2 is specified to be equal to or less than eight, and is preferably specified to two to eight. However, in FIGS. 2 to 10, in the case where the heat dissipating fins 10 to 17 are embodied such that each of the heat dissipating fins 10 to 17 is simply separated or divided into several or small pieces in a direction in which the heat dissipating side surfaces extend, each of the heat dissipating fins 10 to 17 that includes divided or separated pieces is regarded as a single heat dissipating fin.

The problem that occurs in the case where the total number of the flat-plate shaped heat dissipating fins is increased similarly occurs in a related-art example illustrated in FIG. 14. In the example illustrated in FIG. 14, the number of fins that extend so as to face the same direction (so as to parallel to each other) is equal to or more than three in an arbitrary section that perpendicularly intersects two surfaces 3 and 4 of the base 2 (three or more in a section of the heat sink 1, the sections being taken in a direction perpendicular to two surfaces 3 and 4 of the base 2), which is excessive. In the related-art example illustrated in FIG. 14, four fins extend so as to be parallel to each other on the rear surface 4 of the base 2. In this case, the heat dissipating surfaces of the heat dissipating fins are superposed with one another in one of the three-dimensional directions X, Y, and Z. Thus, the unnecessary material is used and heat radiation efficiency (heat dissipation efficiency) is decreased for a large occupied space.

FIG. 3

Figure 3:
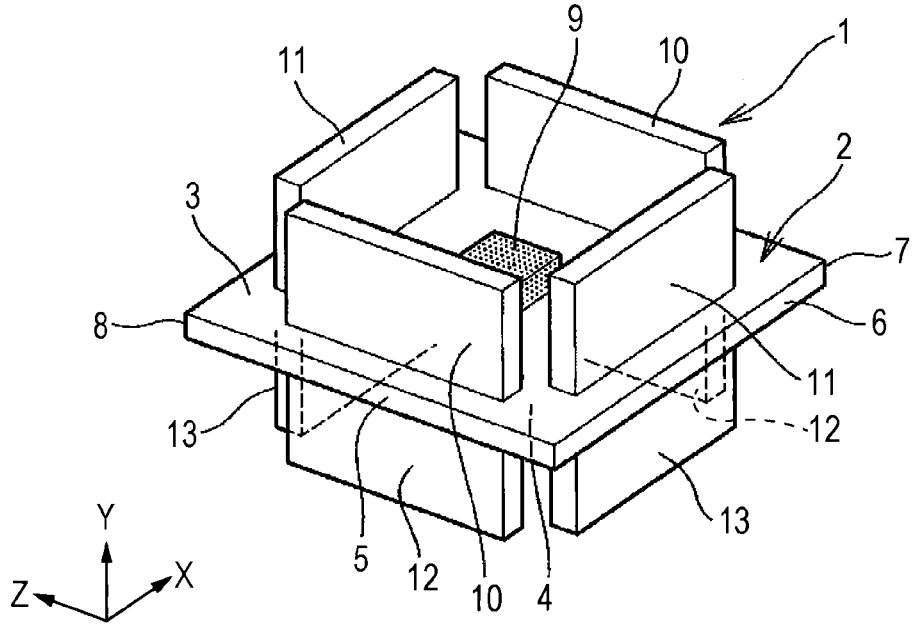
FIG. 3 is a perspective view of another embodiment of the heat sink according to the present invention.

Unlike the heat dissipating fins illustrated in FIG. 2, the flat-plate shaped heat dissipating fins illustrated in FIG. 3 are provided not only on the LED element attachment surface (front surface) 3 side of the base 2 but also on the rear surface 4 side of the base 2. Specifically, in addition to four flat-plate shaped heat dissipating fins 10 and 11 provided on the LED element attachment surface 3 side of the base 2, four heat dissipating fins 12 and 13, that is, two heat dissipating fins 12 and two heat dissipating fins 13, are provided on the rear surface 4 side. Thus, a total of eight of the heat dissipating fins, which is the upper limit of the preferable number of heat dissipating fins, are provided such that the heat dissipating fins 10 and 11 and the heat dissipating fins 12 and 13 are symmetrical with each other about the base 2. The length (width) by which each of these heat dissipating fins 10, 11, 12, and 13 extends on the base 2 is shorter than the length (width) of corresponding one of the sides (side surfaces) 5, 6, 7, and 8 of the rectangular base 2.

The heat dissipating fins 12 and 13 provided on the rear surface 4 side are completely the same as the flat-plate shaped heat dissipating fins 10 and 11 provided on the LED element attachment surface 3 side of the base 2. The heat dissipating fins 12 and 13 and the heat dissipating fins 10 and 11 are symmetrical with one another about a line in the left-right direction in FIG. 3. That is, the LED element 9 is interposed between symmetrically arranged two heat dissipating fins 12 and between symmetrically arranged two heat dissipating fins 13. As embodiments of the fins that extend so as to face the same direction, the heat dissipating fins 12 on the left and right sides in FIG. 2 are parallel to each other, and the heat dissipating fins 13 on the upper and lower sides in FIG. 2 are parallel to each other. That is, the flat-plate shaped heat dissipating fins 12 that oppose each other and the plate-shaped heat dissipating fins 13 that oppose each other are formed on the rear surface 4 side. The heat dissipating surfaces 12 and 13 are located such that the position on the rear surface side corresponding to the position where the LED element 9 is attached is interposed between the heat dissipating fins 12 and between the heat dissipating fins 13 similarly to the flat-plate shaped heat dissipating fins 10 and 11 on the front surface side, which is the LED element attachment side 3. In other words, the flat-plate shaped heat dissipating fins formed on both the front and rear surfaces of the base 2 are positioned such that the LED element 9 is interposed between the opposing plate-shaped heat dissipating fins. Regarding the heat dissipating fins 12 and 13, the number of heat dissipating fins that extend so as to face the same direction is specified to be two in an arbitrary section that perpendicularly intersects the surface 4 of the base 2 (in any section of the heat sink 1 taken in this direction).

The heat dissipating fins 12 and 13 surround such rectangular four peripheral sides around the position corresponding to the position where the LED element 9 is attached on the rear surface 4. The heat dissipating fins adjacent to each other are perpendicular to each other (intersect each other at a right angle with each other), and the flat-plate shaped side surfaces of the heat dissipating fins 12 and 13 having a high emissivity each face the X or Z-direction. Also in the base 2, the LED element attachment surface and the rear surface having a high emissivity face the Y-direction.

Furthermore, not only the plate-thickness-direction side surfaces 5, 6, 7, and 8 on the four peripheral sides of the base 2 and the plate-thickness-direction surfaces (upper surface and both end surfaces) of four flat-plate shaped heat dissipating fins 10 and 11 provided on the LED element attachment surface 3 side of the base 2 but also the plate-thickness-direction surfaces (lower surface and both end surfaces) of the heat dissipating fins 12 and 13 on the rear surface 4 side serve as the heat radiating surfaces. The areas of these plate-thickness-direction surfaces of the heat dissipating fins are comparatively small. However, the numbers of upper/lower and both end surfaces are doubled compared to those illustrated in FIG. 2. Out of the upper and lower surfaces and the end surfaces of the heat dissipating fins 12 and 13, eight surfaces face the X-direction, eight surfaces face the Y-direction, and eight surface face the Z-direction, and these surfaces serve as heat radiating surfaces in the respective directions. That is, not only the flat-plate shaped heat dissipating surfaces on the front and rear surfaces of the base and heat dissipating fins but also the plate-thickness-direction heat dissipating surfaces of the base and the heat dissipating fins have heat dissipating surfaces that face the X-direction, heat dissipating surfaces that face the Y-direction, and heat dissipating surfaces that face the Z-direction in the three-dimensional space.

Thus, also in the case of the heat sink 1 illustrated FIG. 3, the heat dissipating surfaces of the heat dissipating fins are not particularly superposed with one another in each of the X, Y, and Z three-dimensional directions. Thus, the material is economically used, and a high dissipation efficiency is obtained for a small occupied space.

Figure 4:
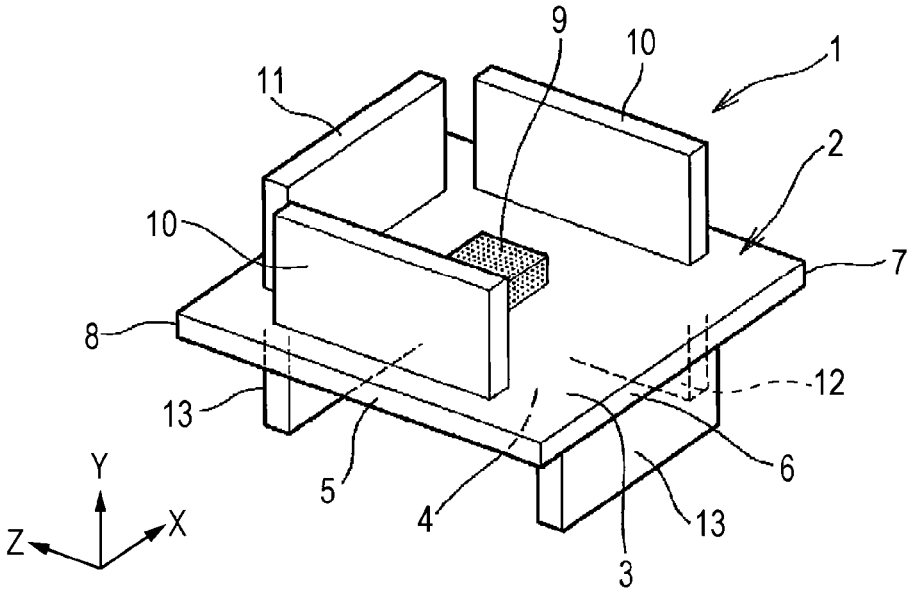
FIG. 4 is a perspective view of another embodiment of the heat sink according to the present invention.
Figure 5:
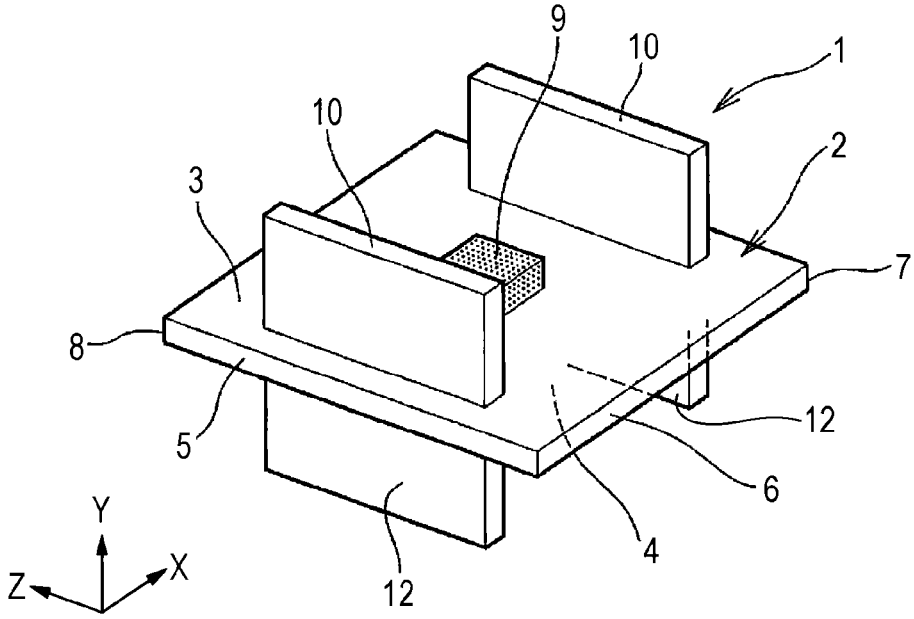
FIG. 5 is a perspective view of another embodiment of the heat sink according to the present invention.
Figure 6:
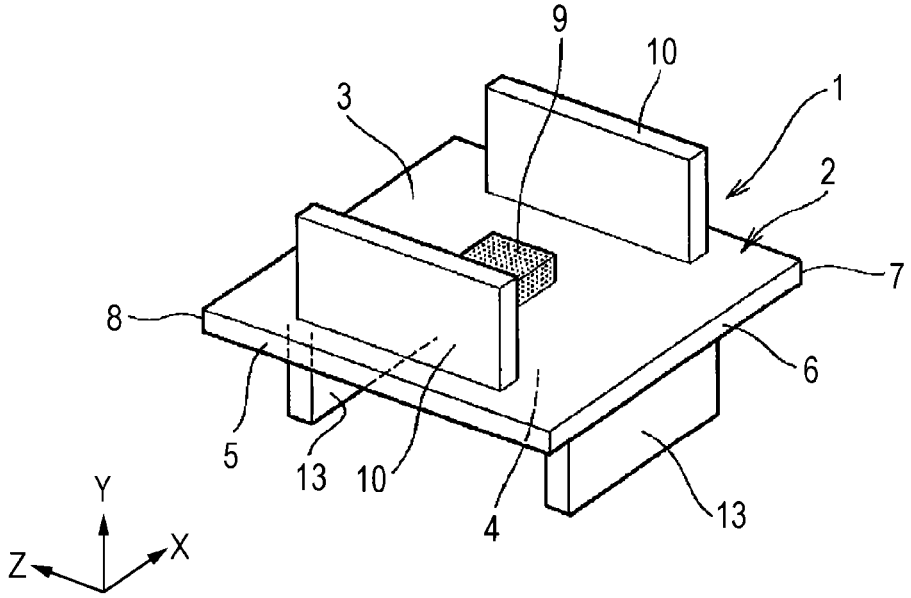
FIG. 6 is a perspective view of another embodiment of the heat sink according to the present invention.

FIGS. 4, 5, and 6

The flat-plate shaped heat dissipating fins in FIGS. 4, 5, and 6 are embodiments where some of the heat dissipating fins are omitted on both the LED element attachment surface 3 side and the opposite rear surface 4 side of the base 2 compared to the case illustrated in FIG. 3 where the upper limit number of the heat dissipating fins is used. Also in the heat sink illustrated in FIGS. 4, 5, and 6, not only the flat-plate shaped heat dissipating surfaces on the front and rear surfaces of the base and heat dissipating fins but also the plate-thickness-direction heat dissipating surfaces of the base and the heat dissipating fins include heat dissipating surfaces that face the X-direction, heat dissipating surfaces that face the Y-direction, and heat dissipating surfaces that face the Z-direction in the three-dimensional space.

Referring to FIG. 4, compared to arrangement of the heat dissipating fins illustrated in FIG. 3, on the LED element attachment surface 3 side of the base 2, the lower one of two heat dissipating fins 11 in FIG. 3 is omitted. Thus, there are three heat dissipating fins on the LED element attachment surface 3 side. Also on the opposite rear surface 4 side, as heat dissipating fin arrangement asymmetrical about the base 2 in FIG. 4, one of two heat dissipating fins 12 on the left side in FIG. 4 is omitted. Thus, there are a total of six heat dissipating fins.

Referring to FIG. 5, compared to arrangement of the heat dissipating fins illustrated in FIG. 3, on the LED element attachment surface 3 side of the base 2, the upper and lower two heat dissipating fins 11 in FIG. 3 are omitted. Thus, there are only two heat dissipating fins 10 on the LED element attachment surface 3 side. Also on the opposite rear surface 4 side, the symmetrical arrangement of the heat dissipating fins that are symmetrical about the base disposed therebetween in FIG. 3 is maintained, and two heat dissipating fins 13 on the upper and lower sides in FIG. 3 are omitted. Thus, there are only two heat dissipating fins 12 on the left and right sides in FIG. 4 and a total of four heat dissipating fins are provided.

Arrangement of the heat dissipating fins in FIG. 6 is the same as that in FIG. 5 in the following points: that is, compared to arrangement of the heat dissipating fins illustrated in FIG. 3, on the LED element attachment surface 3 side of the base 2, the upper and lower two heat dissipating fins 11 in FIG. 3 are omitted. Thus, there are only two heat dissipating fins 10 on the LED element attachment surface 3 side. However, in the arrangement in FIG. 6, the heat dissipating fins are disposed asymmetrically about the base disposed therebetween in FIG. 6, and two heat dissipating fins 12 on the left and right sides in FIG. 3 are omitted. Thus, there are only two heat dissipating fins 13 on the upper and lower sides in FIG. 6 and a total of four heat dissipating fins are provided.

Figure 7:
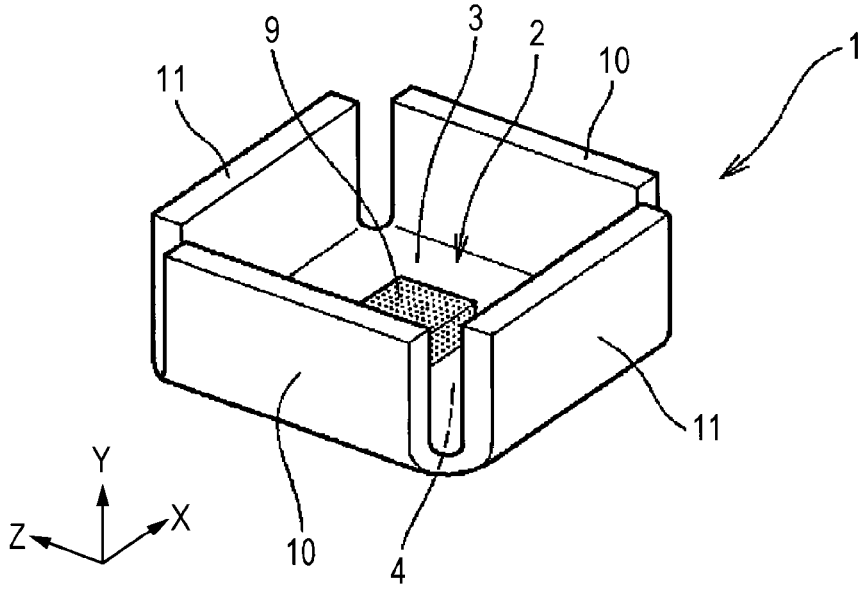
FIG. 7 is a perspective view of another embodiment of the heat sink according to the present invention.

FIGS. 7 and 8

FIGS. 7 and 8 illustrate an embodiment of the heat sink 1 for LED lighting, in which the base 2 (surfaces 3 and 4) and the flat-plate shaped heat dissipating fins 10 to 12 are formed of a thin metal plate having a certain thickness, for example, an aluminum plate, so as to be integral with each other. Also in the heat sink illustrated in FIGS. 7 and 8, not only the flat-plate shaped heat dissipating surfaces on the front and rear surfaces of the base and heat dissipating fins but also the plate-thickness-direction heat dissipating surfaces of the base and the heat dissipating fins includes heat dissipating surfaces that face the X-direction, heat dissipating surfaces that face the Y-direction, and heat dissipating surfaces that face the Z-direction in the three-dimensional space.

Out of the heat dissipating fins 10 to 12, the number of fins that extend so as to face the same direction, which include fins that extend parallel to one another, is specified to be equal to or less than two in an arbitrary section that perpendicularly intersects two surfaces 3 and 4 of the base 2. That is, the number of fins is specified to be equal to or less than two in any section of the heat sink 1 taken in an arbitrary section in a direction that perpendicularly intersects two surfaces 3 and 4 of the base 2.

In this case, the flat-plate shaped heat dissipating fins 10 to 12 are each bent from the end side of the base 2 in the Y-direction (up-down direction in, for example, FIGS. 7 and 8), which is a direction in which each surface extends. Thus, the heat dissipating fins are integrally formed with the base 2 in terms of the material. Referring to FIG. 7, two heat dissipating fins 10 and two heat dissipating fins 11 are bent upward in FIG. 7, so that the heat dissipating fins 10 oppose each other with the LED element 9 interposed therebetween and the heat dissipating fins 11 oppose each other with the LED element 9 interposed therebetween. Referring to FIG. 8, the fins 11 are bent upward in FIG. 8 so as to oppose each other and the fins 12 are bent downward in FIG. 8 so as to oppose each other. In terms of the number and arrangement of these flat-plate shaped heat dissipating fins 10 to 12, the structure illustrated in FIG. 7 is the same as that illustrated in FIG. 2, and the structure illustrated in FIG. 8 is the same as that illustrated in FIG. 6. However, since the heat dissipating fins 10 and 11 are formed by bending the ends of the base 2, arrangement structures located at ends of the base 2 are different between the structures illustrated in FIG. 7 and FIG. 2. For example, the length (width) by which each of these heat dissipating fins 10 and 11 extends on the base 2 is naturally equal to the length (width) of corresponding one of the sides (side surfaces) 5, 6, 7, and 8 of the rectangular base 2.

Figure 9:
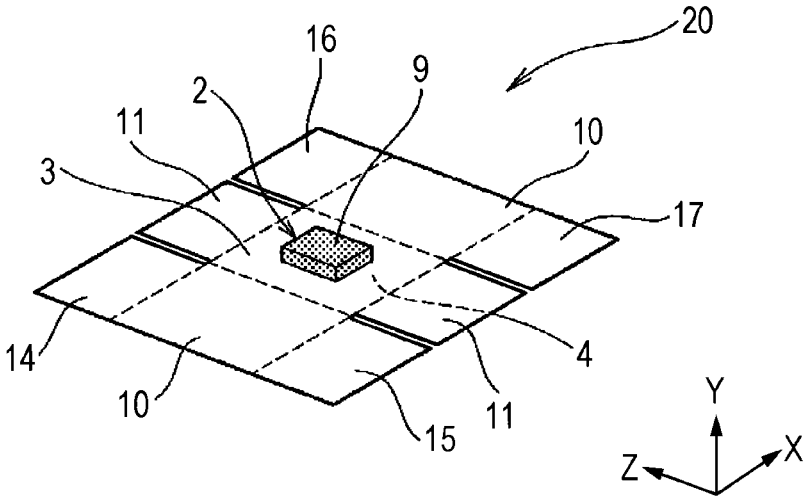
FIG. 9 is a perspective view of another embodiment of the heat sink according to the present invention.
Figure 10:
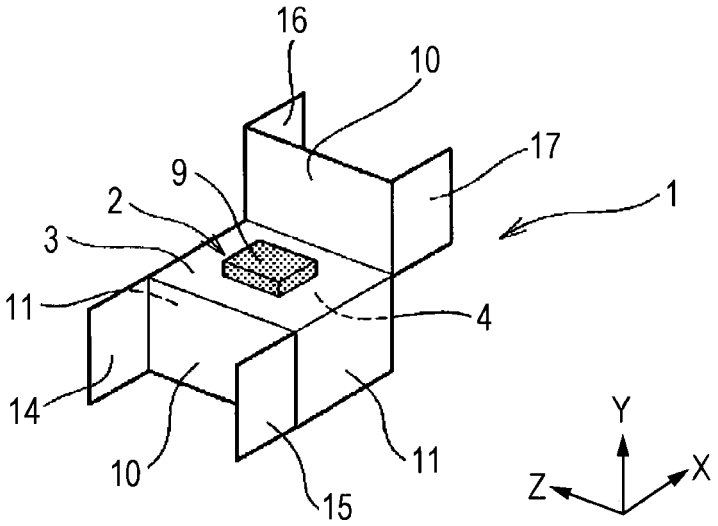
FIG. 10 is a perspective view of the other embodiment of the heat sink according to the present invention.

FIGS. 9 and 10

Similarly to FIGS. 7 and 8, FIGS. 9 and 10 illustrate an embodiment of the heat sink 1 for LED lighting, in which the base 2 (surfaces 3 and 4) and the flat-plate shaped heat dissipating fins 10 to 17 are formed of a thin metal plate having a certain thickness, for example, an aluminum plate, so as to be integral with each other. Also in the heat sink illustrated in FIGS. 9 and 10, not only the flat-plate shaped surfaces on the front and rear surfaces of the base and heat dissipating fins but also the plate-thickness-direction heat dissipating surfaces of the base and the heat dissipating fins include heat dissipating surfaces that face the X-direction, heat dissipating surfaces that face the Y-direction, and heat dissipating surfaces that face the Z-direction in the three-dimensional space.

Here, FIG. 9 is a flat development diagram of the heat sink 1 illustrated in FIG. 10 before the heat sink 1 is formed. The side portions of the base 2 are bent on boundary lines (edges) of the raw-material thin metal plate 20 illustrated in FIG. 9 indicated by dotted lines in the three-dimensional X, Y, and Z-directions so as to integrally form the flat-plate shaped heat dissipating fins 10 and 11 and 14 to 17. Thus, these flat-plate shaped heat dissipating fins 10 and 11 and 14 to 17 are integrally formed with the base 2 in terms of the material.

Referring to FIG. 10, two heat dissipating fins 10, which oppose each other with the LED element 9 interposed therebetween, are respectively bent toward opposite directions, that is, toward the upper and lower sides in FIG. 10. These heat dissipating fins 10 have a total of four of side heat dissipating fins 14 to 17 as follows: the heat dissipating fins 10 on the left and right sides in FIG. 10 respectively have two heat dissipating fins 14 and 15, which are parallel to each other, and two heat dissipating fins 16 and 17, which are parallel to each other, formed by bending the ends (on both sides) of the respective heat dissipating fins 10 in the X-direction. Also, two heat dissipating fins 11, which oppose each other with the LED element 9 interposed therebetween, are bent downward in FIG. 10 from both the sides of the base 2. The length (width) by which each of these heat dissipating fins 10 and 11 extends on the base 2 is equal to the length (width) of corresponding one of the sides (side surfaces) of the rectangular base 2. In other words, FIG. 10 illustrates an example of the shape of a base that has the above-described step.

FIG. 11

Figure 11:
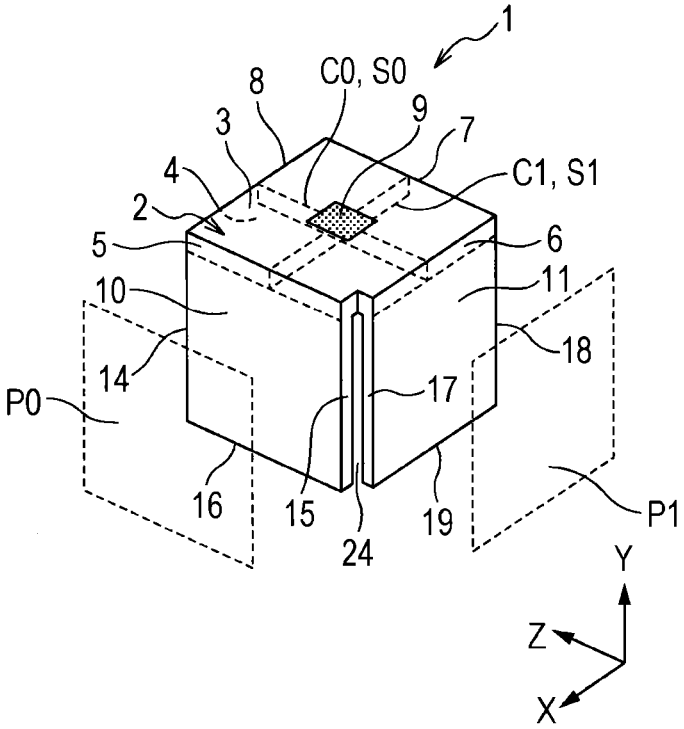
FIG. 11 is a perspective view of another embodiment of the heat sink according to the present invention.

Referring to FIG. 11, the LED element 9 is attached to (mounted on) the surface 3 of the base 2 having a quadrangle (rectangular) shape in plan view. Out of the side surfaces 5, 6, 7 and 8 on the four peripheral sides of the base 2, two side surfaces (two sides) 5 and 6, which are perpendicular to each other, are integrally and continuously formed with two plate-shaped heat dissipating surfaces 10 and 11, which each have a quadrangle (rectangular) shape in plan view and extend from the base 2. That is, in an embodiment illustrated in FIG. 11, when the planar surface (flat surface) of the base 2 is in the Y-direction, the projected area P of the plate-shaped heat dissipating surface 10 that faces the X-direction and the projected are P of the plate-shaped heat dissipating surface 11 that faces the Z-direction are two projected areas of the plate-shaped heat dissipating surfaces in two different directions. Accordingly, the point here is whether or not these projected areas each satisfy $P \geq 8 \times S$ with respect to S, which denotes the sectional area of the base 2 for the corresponding projected area.

The length (width) of each of the plate-shaped heat dissipating surfaces 10 and 11 is the same as the length (width) of a corresponding one of two side surfaces (two sides) 5 and 6 of the base 2. However, when the specified projected area of at least one of the plate-shaped heat dissipating surfaces 10 and 11 can be obtained, the length (width) of either or both of the plate-shaped heat dissipating surfaces 10 and 11 may be smaller than the length (width) of the corresponding one of two side surfaces 5 and 6. Furthermore, the above-described plate-shaped heat dissipating surfaces 10 and 11 may have gaps or slits in a direction in which the base side surfaces 5 and 6 extend so as to divide each of the heat dissipating surfaces 10 and 11 into several pieces or change the area (size) or the shape of the heat dissipating surfaces, thereby changing part of the projected areas.

Furthermore, these two plate-shaped heat dissipating surfaces 10 and 11 project so as to extend from the base 2 (surface 3) with a space (gap) 24 formed therebetween. Although the heat dissipating surfaces 10 and 11 are perpendicular to each other, they do not intersect each other at a right angle with each other. However, when the specified projected area of at least one of the plate-shaped heat dissipating surfaces 10 and 11 can be obtained, the heat dissipating surfaces (heat dissipating fins) 10 and 11 may be intersect each other at a right angle with each other and integrated (continuously formed) with each other without the gap 24 formed therebetween or with the gap 24 partly formed therebetween. This is also applicable similarly to the case where the plate-shaped heat dissipating surfaces such as the other side surfaces 7 and 8 of the base 2 are integrally and continuously formed with each other.

FIG. 12

Figure 12:
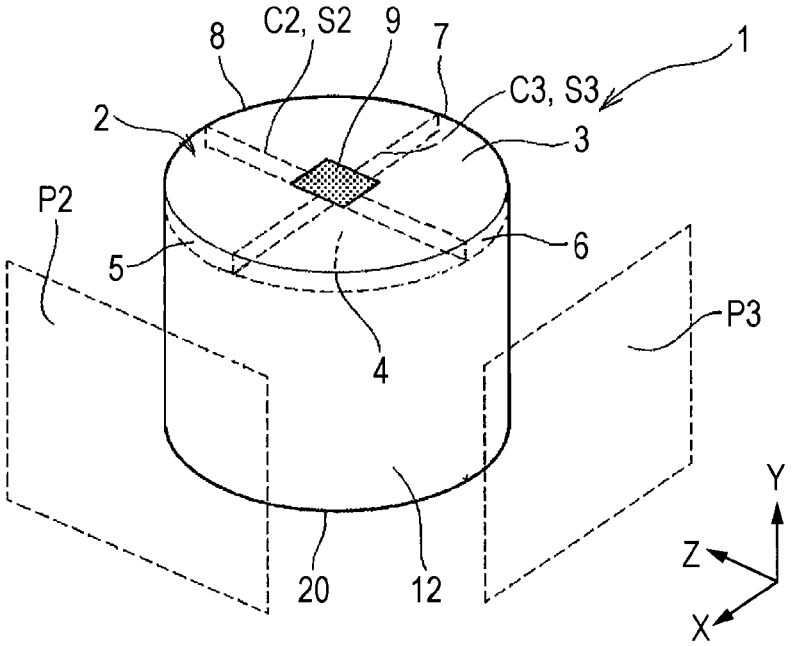
FIG. 12 is a perspective view of another embodiment of the heat sink according to the present invention.

Referring to FIG. 12, the LED element 9 is attached to (mounted on) the surface 3 of the circular base 2 having a perfect circle shape (disc shape) or an elliptical shape in plan view. A cylindrical plate-shaped heat dissipating surface 12 as a single heat dissipating surface is integrally and continuously formed with the entire side surface (entire circumference) having a continuous arc shape around the base 2 so as to extend from the base 2. In an embodiment illustrated in FIG. 12, when the planar surface (flat surface) of the base 2 is in the Y-direction, projected areas P2 and P3 in two directions, which face different directions, that is, the X-direction and the Z-direction, respectively, are projected areas in two different direction. The point here is whether or not the projected area P2 that faces the X-direction and the projected area P3 that faces the Z-direction each satisfy $P \geq 8 \times S$ with respect to S, which denotes the sectional area of the base 2 for the corresponding projected area.

As long as the specified projected area can be obtained, it may be clearly possible that the cylindrical heat dissipating surface 12 is integrally and continuously formed with the base 2 only in a region corresponding to part of the arc-shaped continuous side surfaces (plate-thickness-direction side surfaces or thickness-direction side surfaces) 5, 6, 7, and 8 at the periphery of the base 2 so as to extend from the base 2. That is, the plate-shaped heat dissipating surface 12 is not necessarily formed so as to be continuous with the entire side surfaces (entire circumference) at the periphery (circumference) of the base 2. The plate-shaped heat dissipating surface 12 may be divided into several portions in the circumferential direction with slits or gaps formed therebetween, or part of the heat dissipating surface 12 may be omitted in the circumferential direction and some of the side surfaces 5, 6, 7, and 8 of the base 2 may be partly exposed.

Referring to FIG. 12, the length (width) of the cylindrical plate-shaped heat dissipating surface 12 continuous with the side surfaces of the base 2 at the entire periphery (circumference) is naturally equal to the perimeter of the base 2. As long as the specified projected area can be obtained with the plate-shaped heat dissipating surface 12, part of the divided other plate-shaped heat dissipating surface or part of the integral plate-shaped heat dissipating surface 12 does not necessarily satisfy the specified projected area, and the projected areas of these portions may be smaller than the specified projected area. In the case where the base 2 has a triangle, quadrangle, or polygonal shape in plan view, the plate-shaped heat dissipating surface 12 has a triangle, quadrangle, or polygonal column shape corresponding to the shape of the base 2. In this regard, the heat sink 1 illustrated in FIG. 11 has a quadrangle column shape in which the plate-shaped heat dissipating surfaces 10 and 11 are provided only at two sides of the base having a quadrangle shape in plan view.

These heat sinks 1 according to the present invention have a generally hollow cylindrical three-dimensional shape and is formed of, for example, a metal thin plate having a certain thickness, and preferably formed of an aluminum thin plate or the like, as a single component. That is, in an embodiment of the heat sink 1 according to the present invention, the heat sink 1 is preferably formed by bending or drawing a metal thin plate so that the base 2 and the plate-shaped heat dissipating surfaces 10 to 12 are integrally and continuously formed of a single metal thin plate.

Heat Dissipating Surface

In each example of the heat sink 1 illustrated in FIGS. 11 and 12, as described above, the plate-shaped heat dissipating fins 10 to 12 are integrally and continuously formed with some or all of the side surfaces 5, 6, 7, and 8 of the base 2 so as to extend from the base 2. Thus, the base 2 and the plate-shaped heat dissipating fins 10 to 12 form a continuous heat dissipating surface that is disposed around the LED element 9 and faces all the three-dimensional directions, that is, X, Y, and Z-directions. That is, heat dissipating surfaces include the heat dissipating surfaces that face the X-direction, the heat dissipating surfaces that face the Y direction, and the heat dissipating surfaces that face the Z-direction in the three-dimensional space.

Referring back to FIG. 11, the front and rear surfaces 3 and 4 of the base 2 that face the Y-direction and the flat-plate shaped front and rear surfaces of the plate-shaped heat dissipating surfaces 10 and 11 that face the X and Z-directions form a continuous flat-plate shaped heat dissipating surface that faces the X, Y, and Z-directions. Furthermore, in the case where the heat sink 1 illustrated in FIG. 11 preferably has a certain plate thickness in a range from 0.7 to 6 mm, a continuous flat-plate shaped heat dissipating surface that faces the X, Y, and Z-directions is also formed by the following heat dissipating surfaces: the plate-thickness-direction (thickness direction) side surfaces 7 and 8 of the base 2; both the plate-thickness-direction (thickness direction) side surfaces 14 and 15 and the bottom surface 16 of the plate-shaped heat dissipating surface 10; and both the plate-thickness-direction (thickness direction) side surfaces 17 and 18 and the bottom surface 19 of the plate-shaped heat dissipating surface 11. By forming the gap 30 between the plate-shaped heat dissipating surfaces 10 and 11, the above-described plate-thickness-direction side surface 15 of the plate-shaped heat dissipating surface 10 and the plate-thickness-direction side surface 17 of the plate-shaped heat dissipating surface 10 can be obtained. As described above, in FIG. 11, not only the flat-plate shaped heat dissipating surfaces on the front and rear surfaces of the base and the plate-shaped heat dissipating surfaces (heat dissipating fins) but also the plate-thickness-direction heat dissipating surfaces of the base and the plate-shaped heat dissipating surfaces include the heat dissipating surfaces that face the X-direction, the heat dissipating surfaces that face the Y-direction, and the heat dissipating surfaces that face the Z-direction in the three-dimensional space.

The heat sink 1 illustrated in FIG. 12 has only one plate-shaped heat dissipating surface 12. However, the plate-shaped heat dissipating surface 12 is continuously and integrally formed into a circular shape (arc shape or cylindrical shape) over the entire circular (continuous arc shape) side surfaces (entire circumference) around the base 2. Thus, the heat sink 1 illustrated in FIG. 12 also has a continuous heat dissipating surface formed of the front and rear surfaces 3 and 4 of the base 2 that face the Y-direction, the flat-plate shaped front and rear surfaces of the plate-shaped heat dissipating surface 12 that face the X and Z-directions, and preferably, when there is a certain plate thickness in a range from 0.7 to 6 mm, the bottom surface 20 that faces the Y-direction and continuous so as to form a circular shape (arc shape). As described above, also in FIG. 12, not only the flat-plate shaped heat dissipating surfaces on the front and rear surfaces of the base and the plate-shaped heat dissipating surfaces (heat dissipating fins) but also the heat dissipating surface of the bottom surface 20 of the plate-shaped heat dissipating surface 12 includes the heat dissipating surfaces that face the X-direction, the heat dissipating surfaces that face the Y-direction, and the heat dissipating surfaces that face the Z-direction in the three-dimensional space. Accordingly, a continuous heat conductive surface is formed, in which heat from the LED element 9 is continuously conducted to the rear surface 4 and the plate-shaped heat dissipating surfaces 10 to 12 through the LED element attachment surface (front surface) 3 of the base 2. A continuous heat dissipating surface in which heat is continuously radiated from the continuous heat conductive surface is also formed.

Projected Area of Plate-Shaped Heat Dissipating Surface

Assuming that the heat sink has basic structure in which the heat dissipating surfaces includes the heat dissipating surface or surfaces that face the X-direction, the heat dissipating surface or surfaces that face the Y-direction, and the heat dissipating surface or surfaces that face the Z-direction in the three-dimensional space, in the present invention, the projected areas P of plate-shaped heat dissipating surfaces in two different directions of the plate-shaped heat dissipating surfaces 10 to 12 are specified to satisfy $P \geq 8 \times S$, that is, each projected area P is specified to be equal to or more than eight times the sectional area S of the base corresponding to the projected area P, and preferably satisfy $P \geq 12 \times S$, that is, each projected area P is specified to be equal to or more than 12 times the sectional area S of the base corresponding to the projected area P. In other words, when the projected areas P of the plate-shaped heat dissipating surfaces in two different directions each satisfy the relationship (expression) $P \geq 8 \times S$, and preferably satisfy the relationship (expression) $P \geq 12 \times S$, another plate-shaped heat dissipating surfaces or part of the plate-shaped heat dissipating surfaces are not necessarily satisfy this relationship.

By setting the sizes of both the projected areas P of the plate-shaped heat dissipating surfaces in two different directions to equal to or larger than a certain size so that these projected areas P satisfy the relationship with the sectional area S of the base, the efficiency of heat dissipation mainly performed by radiation can be significantly improved when the heat sink is used in a closed space. That is, by setting the projected area to a size equal to or larger than this certain size, in a closed space such as a space for a vehicle LED lamp, in which air convection is almost or completely inhibited, heat from the LED element 9 can be mainly dissipated by radiation with the heat sink of the type illustrated in FIGS. 11 and 12, thereby significantly improving the heat dissipation efficiency. In other words, the heat sink as illustrated in FIG. 11 or 12, which includes the heat dissipating surfaces that face the X-direction, the heat dissipating surfaces that face the Y-direction, and the heat dissipating surfaces that face the Z-direction in the three-dimensional space, produces a synergistic effect due to its shape (structure) and the above-described projected area P. Because of the synergistic effect, in a closed space such as a space for a vehicle LED lamp, in which air convection is almost or completely inhibited, heat from the LED element 9 can be mainly dissipated by radiation, thereby significantly improving the heat dissipation efficiency.

In contrast, with the plate-shaped heat dissipating surfaces 10 and 11, or the plate-shaped heat dissipating surface 12, when it is not realized that the projected areas P of the plate-shaped heat dissipating surfaces in two different directions satisfy the relationship, that is, when either of both of the projected areas P are excessively small and $P < 8 \times S$, that is, the projected area P is less than eight times the sectional area S of the corresponding base, the efficiency of heat dissipation mainly performed by radiation cannot be improved when the heat sink is used in a closed space. In other words, even with the heat sink as illustrated in FIG. 11 or 12, which includes heat dissipating surfaces that face the X-direction, the heat dissipating surfaces that face the Y direction, and the heat dissipating surfaces that face the Z-direction in the three-dimensional space, a synergistic effect with its shape (structure) is not produced. Thus, in a closed space such as a space for a vehicle LED lamp, in which air convection is almost or completely inhibited, heat from the LED element 9 cannot be mainly dissipated by radiation, or the heat dissipation efficiency cannot be significantly improved. As described above, when the heat sink illustrated in FIG. 11 or 12, which includes the heat dissipating surfaces that face the X-direction, the heat dissipating surfaces that face the Y direction, and the heat dissipating surfaces that face the Z-direction in the three-dimensional space, is used in a closed space such as a space for a vehicle LED lamp, there is a particular problem, which is produced by a synergistic effect due to the shapes of the heat dissipating surfaces and the three-dimensional shape, in that the projected area of the plate-shaped heat dissipating surfaces significantly affects heat dissipation performed by radiation.

Here, the projected areas of the plate-shaped heat dissipating surfaces 10 to 12 are defined as a projected area P of each of the plate-shaped heat dissipating surfaces 10 to 12 projected by a parallel beam emitted in a direction perpendicular to each of the heat dissipating surfaces. When the angle of the emitted parallel light is not at a right angle and at an angle other than a right angle with each of the plate-shaped heat dissipating surfaces, one of the conditions under which radiant heat transfer most effectively occurs, that is, the heat dissipating area in the case where two heat conductive surfaces face each other, is not specified. Accordingly, the resultant value is not preferable as an index for correctly determining heat dissipating performance of the plate-shaped heat dissipating surface. The projected area defined in this case becomes a heat dissipating area in the case where the heat conductive surfaces most efficiently perform radiant heat transfer and is preferable as an index that most adequately expresses influences of the heat dissipating area of the heat conductive surfaces.

In the present invention, the projected area P of each of the plate-shaped heat dissipating surfaces 10 to 12 is specified as a multiplying factor with respect to the sectional area S of the base 2 illustrated in FIG. 11 or 12. As indicated by dotted lines in the base 2 in FIGS. 11 and 12, the sectional area S of the base 2 is the sectional area S of each section C, which passes through (intersect) the LED element 9 attachment position of the base 2 and is parallel to the plane of projection of corresponding one of the plate-shaped heat dissipating surfaces 10 to 12.

Referring to FIG. 11, the projected area P0 of the plate-shaped heat dissipating surface 10 and the projected area P1 of the plate-shaped heat dissipating surface 11 are the projected areas P of two plate-shaped heat dissipating surfaces in different directions that need to satisfy the specification. That is, the projected area P0 needs to satisfy $P \geq 8 \times S$ with respect to the area S0 of the section C0. The projected area P0 is projected by light emitted in a direction perpendicular to the plate-shaped heat dissipating surface 10. The area S0 of the section C0, which passes through the LED element 9 attachment position and is parallel to the plane of projection of the plate-shaped heat dissipating surface 10, is a sectional area of the base 2. Furthermore, the projected area P1 need to satisfy $P \geq 8 \times S$ with respect to the area S1 of the section C1. The projected area P1 is projected by light emitted in a direction perpendicular to the plate-shaped heat dissipating surface 11. The area S1 of the section C1, which passes through the LED element 9 attachment position and is parallel to the plane of projection of the plate-shaped heat dissipating surface 11, is a sectional area of the base 2.

In the heat sink 1 illustrated in FIG. 12, the base may have an elliptical shape or an arc shape. In this case, whether or not at least one of two projected areas P2 and P3 satisfies the specification is checked. The projected area P2 is a projected area of the major axis side (or large area side) of the plate-shaped heat dissipating surface and the projected area P3 is a project area of the minor axis side (or small area side), which is in a direction different from that of the major axis side) of the plate-shaped heat dissipating surface. When the base has a perfect circle shape, the projected area in any direction is the same. Thus, when the direction of the planar surface (flat surface) of the base 2 is the Y-direction, at least two plate-shaped heat dissipating surfaces in the X and Z directions, which are different from each other, are selected. These two plate-shaped heat dissipating surfaces are a plate-shaped heat dissipating surface, the projected area P2 of which faces the X direction and a plate-shaped heat dissipating surface, the projected area P3 of which faces the Z-direction. These projected areas P2 and P3 of the plate-shaped heat dissipating surfaces each need to satisfy $P \geq 8 \times S$ with respect to a corresponding one of the sectional area S of the base 2. That is, the projected area P2 or P3 need to satisfy $P \geq 8 \times S$ with respect to the area S2, S3 of the section C2, C3. The projected area P2, P3 is projected by light emitted in a direction perpendicular to the plate-shaped heat dissipating surface. The area S2, S3 of the section C2, C3, which passes through the LED element 9 attachment position and is parallel to the plane of projection of the plate-shaped heat dissipating surface, is a sectional area of the base 2.

Principle and Operation of Heat Dissipation

The principle (operation) of heat dissipation is described. Here, LED lighting is performed in a space where air convection is inhibited and the above-described heat sink 1 according to the present invention is disposed in the space. When the LED element 9 disposed on the LED attachment surface 3 emits light, heat (heat flux) Q generated by the LED element 9 is conducted to the LED attachment surface 3 of the base 2 through the attachment portion (not shown) at the bottom portion of the LED element 9 along with the light emission from the LED element 9. Then, the heat Q conducted to the LED element attachment surface 3 is continuously and quickly (without delay) conducted not only to the heat dissipating fins 10 and 11 on the attachment surface 3 side but also to the rear surface 4, the heat dissipating fins 12 and 13 on the rear surface 4 side, and other heat dissipating surfaces at a substantially equally high level. Thus, heat dissipation particularly by radiation is performed from the heat dissipating surfaces of these fins at equal to or higher than a certain level, thereby heat dissipation efficiency can be improved.

Here, as specified in the present invention, among the heat dissipating fins 10 to 17, the number of fins that extend so as to face in the same direction is specified to be equal to or less than two also in an arbitrary section perpendicular to the surfaces 3 and 4 of the base 2, thereby suppressing excessive superposition in the same directions. Thus, the conducted heat Q is directed to each of the three-dimensional X, Y, and Z-directions and quickly and efficiently radiated from the attachment and rear surfaces 3 and 4 of the base 2, the surfaces of the heat dissipating surfaces of the heat dissipating fins 10 to 17, and the like to the surrounding closed space (heat dissipating space). Accordingly, the heat generated by the LED element 9 is dissipated in each of the three-dimensional X, Y, and Z-directions with a high radiation efficiency of equal to or more than a certain heat dissipation amount. The reason of this is that the projected area is large in each of the X, Y, and Z-directions for the small number of heat dissipating fins 10 to 17 of the heat sink 1 of the present invention even in a close heat dissipating space in a lighting fixture where air convection is almost inhibited and heat dissipation efficiency is determined by radiation. The heat sink 1 according to the present invention has good characteristics in which heat dissipation efficiency per unit heat dissipating area is high despite its simple structure with the small number of heat dissipating fins 10 to 17.

Here, in the case of heat dissipation performed by radiation, which is required for a small or closed space of housing for vehicle lighting, heat dissipation efficiency is determined by the size of the projected area in the X, Y, and Z-directions (three-dimensional directions) illustrated at the lower left or the lower right in FIGS. 2 to 8. As these projected areas increase, heat radiation efficiency is improved.

In this regard, the projected area of a related-art heat sink H illustrated in FIG. 14 in the Y-direction is the total of the flat surface of a base portion 30 and the upper flat surfaces of the fin portions 40, and accordingly, fin portions 40 are not superposed one another. Thus, the material is economically used and the projected area is larger. However, the projected area in the Z-direction is the total of the side surfaces of the base portion 30 and the side surfaces of the fin portions 40. Thus, the projected area has a comb shape that has many spaces, and the area, which is less than 50% of the total area calculated by multiplying the length of the base portion 30 by the height of the fin portions 40, is small. The projected area in the X-direction is the total of the front surface of the base portion 30 and the front surface of the fin portions 40. Despite the presence of four fin portions 40, the fin portions 40 are superposed with one another, and the projected area of four fin portions 40 is equal to that of one fin portion 40. Thus, a large amount of the unnecessary material is used and the heat radiation efficiency per unit heat dissipating area is low. That is, a number of fins are superposed with one another and occupy the space in the X-direction. However, the projected area is small for the large occupied area, and the heat radiation efficiency is low. Furthermore, the fins are excessively provided in the X-direction, a large amount of the unnecessary material is used because of these excessively provided fins, and the weight may be increased.

In other words, with the related-art heat sink H illustrated in FIG. 14, heat radiation efficiency is inevitably decreased in one of the X, Y, and Z-directions (three-dimensional directions). As a result, an increase in heat radiation efficiency in the entire three-dimensional directions is not achieved and the heat radiation efficiency is generally decreased. Furthermore, as described above, the fins are excessively provided in, for example, the X-direction, and accordingly, a large amount of the unnecessary material is used. In general with the related-art, a heat sink, with which the material is economically used and high heat radiation efficiency is achieved despite a small occupied space in each of the three-dimensional directions of the heat sink, cannot be realized.

In this regard, Japanese Unexamined Patent Application Publications No. 2008-130232 cited before has a similar problem in that, in a direction in which a number of U-shaped dipper-like portions of heat dissipating members are superposed with one another, heat radiation efficiency is low despite a large occupied space, and a large amount of the unnecessary material is used particularly in the X-direction from a viewpoint of general heat radiation efficiency in three direction of the three dimensions. Furthermore, the width of the slit-shaped opening is significantly restricted and naturally decreased due to the size of the heat sink members and the area to be allocated on the heat dissipating component side. When this heat sink is applied to a closed space, actual improvement of heat dissipation efficiency due to air convection is not achieved as much as intended.

FIG. 13

Figure 13:
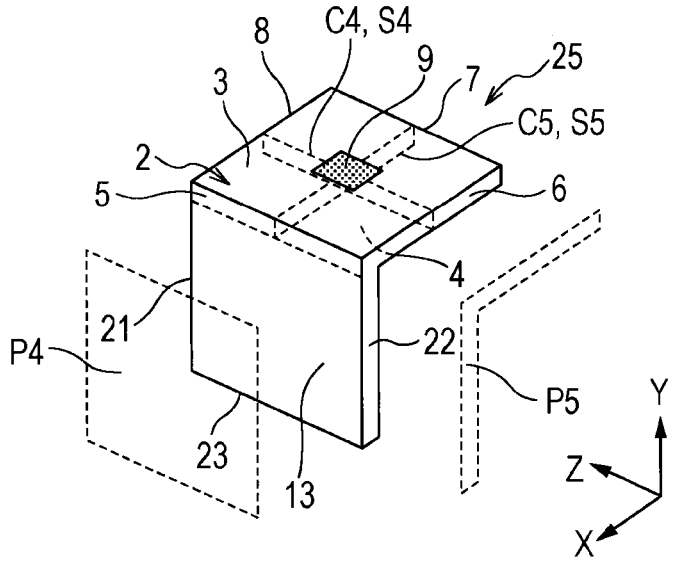
FIG. 13 is a perspective view of a comparative example of a heat sink.

A heat sink 25 illustrated in FIG. 13 is a comparative example having only one plate-shaped heat dissipating surface 13 on one side surface of the base. Thus, even when the projected area of the plate-shaped heat dissipating surface 13 is increased as much as possible, heat dissipation efficiency by radiation is insufficient.

Referring to FIG. 13, the LED element 9 is attached to the surface 3 of the base 2 having a quadrangle shape (rectangular shape) in plan view, and, one plate-shaped heat dissipating surface 13 is integrally and continuously formed with the side surface 5 out of the side surfaces 5, 6, 7, and 8 on the four peripheral sides of the base 2 so as to extend from the base 2. That is, in comparison with an example illustrated in FIG. 11, the heat sink 25 is basically similar to the example illustrated in FIG. 11 except for the plate-shaped heat dissipating surface 11 of the side surface 6 of the base 2, which is omitted from the heat sink 25.

Furthermore, in the heat sink 25 illustrated in FIG. 13, only the plate-shaped heat dissipating surface 13 of the side surface 5 is provided as the plate-shaped heat dissipating surface of the side surface of the base. A continuous flat-plate shaped heat dissipating surface that faces two directions, that is, the X and Y-directions, is formed of the front and rear surfaces 3 and 4 of the base 2, which faces the Y-direction, and the flat-plate shaped heat dissipating surface 13, which faces the X-direction. When the base and the plate-shaped heat dissipating surface 13 have a certain thicknesses in a range from 0.7 to 6 mm, the plate-thickness-direction (thickness direction) side surfaces 6, 7, and 8 of the base 2, both the plate-thickness-direction (thickness direction) side surfaces 21 and 22 of the plate-shaped heat dissipating surface 13, and the bottom surface 23 serve as heat dissipating surfaces. A projected area P4 of the plate-shaped heat dissipating surface 13 satisfies $P \geq 8 \times S$ with respect to the sectional area S4 of the section C4 of the base 2.

However, the heat dissipating surfaces provided in the heat sink 25 illustrated in FIG. 13 in the Z-direction is the plate-thickness-direction (thickness direction) side surface 6 of the base 2 and both the plate-thickness-direction (thickness direction) side surfaces 21 and 22, and there is no flat-plate shaped heat dissipating surface. As a result, an increase in a projected area P5 of the heat dissipating surfaces that face the Z-direction, which include the side surfaces 6, 21, and 22, is limited, and the projected area P5 cannot satisfy $P \geq 8 \times S$. Thus, even when the projected area P4 of the plate-shaped heat dissipating surface 13 satisfies the projected area in the X-direction, the projected area of the heat dissipating surfaces in the Z-direction is insufficient. Accordingly, at least two plate-shaped heat dissipating surfaces that face different directions cannot satisfy $P \geq 8 \times S$. For this reason, the property of heat dissipation by radiation of the heat dissipating surfaces in the Z-direction is small, and generally sufficient radiation and heat dissipation property is not realized.

Power Consumption of LED

Although the heat sink 1 according to the present invention produces a good heat dissipation effect, when power consumption of the LED element 9 that serves as the heat source is significantly increased, the heat dissipating performance is not sufficient even with the good heat dissipation effect. Thus, as a preferable range to which the present invention is applied, a preferable range of power consumption of the LED element 9 can be equal to or less than 20 W. In the case where a plurality of LED element 9 of comparatively small power consumption are attached, the sum of power consumptions of the plurality of LED element 9 is preferably in a range equal to or less than 20 W.

Raw Material

The heat sink 1 according to the present invention can produce a good heat dissipation effect with a simplified structure instead of a complex shape and structure thereof and by decreasing the number of heat dissipating surfaces instead of increasing the number of heat dissipating surfaces. As a result, a raw material and a manufacturing method or process of the heat sink 1 can be respectively selected from among a variety of materials and a variety of methods or processes. Thus, a low cost and easy-to-manufacture heat sink can be provided. The raw material of the heat sink 1 can be selected from among, for example, aluminum (pure aluminum), an aluminum alloy, copper (pure copper), a copper alloy, a steel plate, resin, ceramic, or the like. The manufacturing method or process can be selected from among drawing or bending for processing a raw material plate, or die-casting, casting, forging, extruding, or the like.

Aluminum or Aluminum Alloy

Aluminum (pure aluminum) or an aluminum alloy is a preferable raw material of the heat sink 1, because aluminum or an Aluminum alloy has the characteristics required for the heat sink 1 such as strength, rigidity, corrosion resistance, a thermally conductive property, heat transferring property, a heat dissipation property, and workability, and is light in weight. Among aluminums (pure aluminum) or aluminum alloys, 1000 series pure aluminums designated by Aluminum Association (AA) number or specified in Japanese Industrial Standards (JIS) such as AA or JIS 1050, which has particularly high thermal conducting characteristics and heat dissipation characteristics required for the heat sink 1, are preferable.

The heat sink according to the present invention is optimal in an usage (installation) state in which, for example, a surrounding heat dissipating space is closed, the volume of the heat dissipating space is small, and air convection is almost inhibited, and in an usage (installation) environment in which there is little possibility that heat dissipation is performed by air convection. In order to dissipate heat in such a usage environment, it is required that heat be mainly dissipated by radiation. Accordingly, with the related-art heat sink structure, the heat dissipating performance of which are mainly achieved by air convection with the increased area of heat dissipating surfaces such as fins, heat dissipation by radiation is insufficient, and generally efficient heat dissipation cannot be achieved. In contrast, the heat sink according to the present invention dissipates heat mainly through heat radiation from the heat dissipating surfaces such as the heat dissipating side surfaces. Thus, the heat sink according to the present invention is optimal in the usage (installation) environment in which there is little possibility that heat dissipation is performed by air convection.

Furthermore, the heat dissipating surfaces including the LED element 9 attachment surface 3 and the heat dissipating fins are integrally formed without joining surfaces provided therebetween. Thus, thermal contact resistance, which may be generated, for example, in the case where these components are separately formed and joined to one another, is not generated. Accordingly, heat is easily conducted between the LED element attachment surface 3 and the heat dissipating surfaces. As a result, the heat dissipating performance of the heat sink is generally significantly improved. Furthermore, the heat sink 1 structure has a high rigidity since the heat sink 1 structure includes the heat dissipating fin or fins that face the X-direction, the heat dissipating fin or fins that face the Y-direction, and the heat dissipating fin or fins that face the Z-direction in the three-dimensional space. Thus, even when the heat sink is used in an application, for example, subjected to vibration such as vehicle lighting, the shape of the heat sink can be maintained without a particular reinforcing member. This can eliminate the need for the maintenance and extend the life of the heat sink.

Common Features Throughout Embodiments

A space for attaching a component, a slit, a partial shape, and the like may be formed at part of the surfaces of the above-described attachment surface 3 and the rear surface 4 of the base 2 and the heat dissipating surfaces of the heat dissipating fins 10 to 17 in accordance with application or the attachment position of the heat sink 1 by cutting these surfaces or performing a three-dimensional forming process for forming irregularities or a step on these surfaces. Furthermore, part of the heat dissipating surfaces may be omitted or the shapes thereof may be changed in accordance with the need for, for example, attaching a component.

The heat sink 1 according to the present invention can produce a good heat dissipation effect with a simplified structure instead of a complex shape and structure thereof, in particular instead of a complex shape and structure of the heat dissipating fins, and by decreasing the number of heat dissipating fins instead of increasing the number of heat dissipating fins. As a result, a raw material and a manufacturing method or process of the heat sink 1 can be respectively selected from among a variety of materials and a variety of methods or processes. Thus, a low cost and easy-to-manufacture heat sink can be provided.

Aluminum

However, aluminum (pure aluminum) or an aluminum alloy is a preferable raw material of the heat sink 1, because aluminum or an Aluminum alloy has the characteristics required for the heat sink 1 such as strength, rigidity, corrosion resistance, a thermally conductive property, a heat radiating property, and workability, and is light in weight. Among aluminums (pure aluminum) or aluminum alloys, 1000 series pure aluminums designated by Aluminum Association (AA) number or specified in Japanese Industrial Standards (JIS) such as AA or JIS 1050, which has particularly high thermal conducting characteristics required for the heat sink 1, are preferable.

Attachment to Vehicle Lamp

The heat sink according to the present invention can be attached to a vehicle LED lamp or the like in a manner similar to that for generally used existing heat sinks. This is one of advantages of the heat sink according to the present invention. A typical vehicle LED lamp (vehicle lighting fixture) includes an LED board, a reflector, a housing, an outer lens, and a heat sink. An LED element as a light source is mounted on the LED board. The reflector reflects light from the LED toward the front side in the light emitting direction. The LED board and the reflector are enclosed by the housing. The outer lens is formed of a transparent material and closes the open front end of the housing. The heat sink is in thermal contact with the LED board. The reflector is formed of a resin material and has a parabolic reflection surface having a focus near the LED on the LED board. Here, the heat sink according to the present invention is used as a heat sink that is in thermal contact with the above-described LED board or an LED board.

Figure 15:
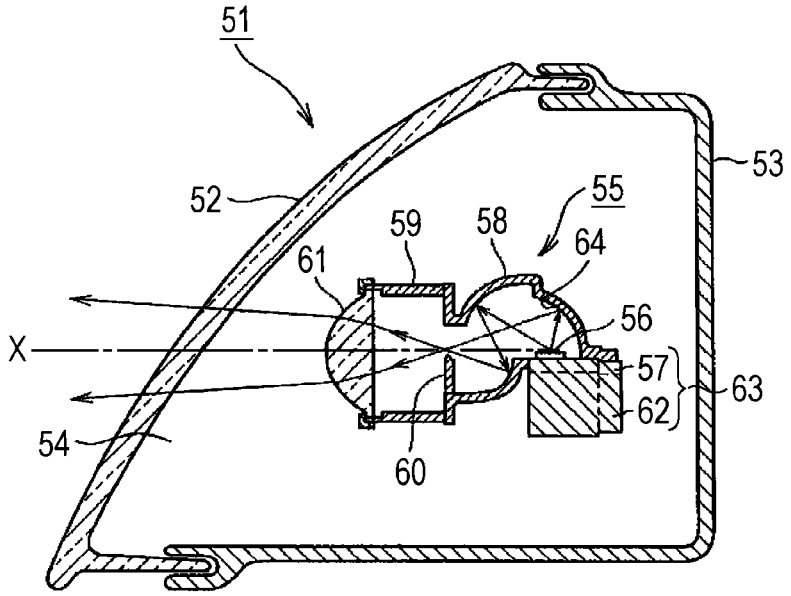
FIG. 15 is a sectional view of an example of a vehicle light emitting diode lamp that includes a related-art heat sink therein.

In this regard, the heat sink according to the present invention can be disposed in, for example, the aforementioned vehicle LED lamp illustrated in FIG. 15 as a lighting unit 55 as follows: the base 2 of the present invention, on which the LED element is mounted, is attached as a heat sink to the mount plate 57. Even in this case, there is a significant difference between the heat sink according to the present invention and the related art heat sink as follows: that is, as a vehicle LED lamp, the heat sink according to the present invention dissipates heat mainly by heat radiation instead of heat dissipation of the related-art heat sink mainly performed by convection caused by heat transfer to surrounding air.

EXAMPLES

The heat sinks having shapes illustrated in FIGS. 2, 3, 7, and 14 are actually produced. For the shape of each drawing, a plurality of the heat sinks are produced so as to have varied projected areas. An LED element is attached to (mounted on) each heat sink, and current is applied to the LED element so as to cause the LED element to emit light. The average temperatures (in ° C.) of the LED elements in a steady state are measured. The results are listed in Table 1.

In each of the heat sinks, the projected area of the heat sinks having the shape illustrated in the same drawing (have the same shape) is varied by changing the Y-direction height and plate thickness of the flat-plate shaped side surface of each of the rectangular heat dissipating fins. In so doing, among the heat sinks having the shape illustrated in the same drawing (have the same shape), the size and shape of the base 2 in plan view is the same as one another. Also, in each heat sink, the plate thickness of all the base 2 and the heat dissipating fins are the same as one another. The heat resistance R is calculated by the aforementioned method and expression.

The heat sinks illustrated in FIGS. 2, 3, and 14 are produced by machining such as cutting an extruded rod formed of JIS 1050 system aluminum. The heat sinks illustrated in FIG. 7 is produced by performing a pressing process on a JIS 1050 system aluminum cold-rolled sheet so that the end portions are bent into heat dissipating fins. Thermal conductivity $\lambda$ of the heat sinks illustrated in FIGS. 2, 3, and 14 is 230 W/(m·K), and thermal conductivity $\lambda$ of the heat sinks illustrated in FIG. 7 is 231 W/(m·K). These thermal conductivities $\lambda$ are equal to or greater than 120 W/(m·K).

In each of the heat sinks, the size of the rectangular base 2 is set to 100 mm (Z-direction)×100 mm (X-direction)× plate thickness 2 mm. In the heat sinks illustrated in FIGS. 2, 3, and 7, the distance between the heat dissipating fins 10, which are parallel to each other, on the left and right sides and the distance between the heat dissipation fins 11, which are parallel to each other, on the upper and lower sides are set to equal to or more than 80 mm (distance from the center of the LED element is equal to or more than 35 mm). In the heat sinks illustrated in FIG. 14, the distance between the neighboring heat dissipating fins 40 is set to 10 mm. In each of the heat sinks, the size of the rectangular shape of the heat dissipating fins is set as follows: the length of the flat-plate shaped side surfaces in the X-direction or the Z-direction is set to 70 mm; and the height of the flat-plate shaped side surfaces in the Y-direction varied in a range from 35 to 80 mm, thereby varying the projected area of the heat dissipating surfaces of the heat sinks.

The surfaces of each heat sink are coated with a commercial cationic black resin film by performing electrodeposition. In this state, the surface emissivity $\epsilon$ of the heat sinks (bases and heat dissipating fins) is measured with the aforementioned portable emissivity measuring device. The result at the heat dissipating surfaces of the base 2 and the heat dissipating fins 10 to 17 in each heat sink is the same value, 0.83.

In each heat sink, a commercial LED element of 13 W power consumption is mounted on the base, and 3.7 V, 0.85 A current is applied from a Direct Current power unit so as to cause the LED element to emit light. In so doing, the heat sinks are each sealed and disposed in a wooden column-shaped body of 300×300×300 mm, which simulates a closed space for a vehicle LED lamp where air convection is inhibited while monitoring the temperature of the LED element with a thermocouple. By simulating the closed space for the vehicle LED lamp, the ambient temperature around the heat sink is set to 20° C., and in this room atmosphere, the LED element is caused to emit light. After a certain time period has passed, the temperature in a steady state, in which the temperature does not increase or decrease, is measured. The temperature is measured five times for each heat sink so as to obtain an average temperature, which is evaluated as an average temperature (° C.) in a steady state.

As shown in Table 1, examples 1, 2, 5, 6, 9, and 10, which are heat sinks having preferable shapes illustrated in FIGS. 2, 3, and 7, are formed of, as described above, aluminum having a thermal conductivity $\lambda$ of equal to or more than 120 W/(m·K) for the bases and the plate-shaped heat dissipating surfaces, and the surface emissivity $\epsilon$ of the bases and the plate-shaped heat dissipating surfaces is equal to or more than 0.80. Under the above-described conditions, the plate thickness of each of these heat sinks is 2.0 mm, which is within the specified range from 0.9 to 6 mm, and the total projected area of the heat dissipating surfaces of each of these heat sinks is within the specified range from 19000 to 60000 $mm^2$.

As a result, even in a closed space that simulates the vehicle LED lamp in which air convection is inhibited, the temperature of the LED element in the steady state is maintained at equal to or lower than 42° C., which is a very low temperature equal to or lower than 100° C. that is the temperature previously described as an example allowable temperature at or under which luminous efficiency of the LED element is not decreased. Also, the heat resistance R is equal to or less than 4.0 K/W. Thus, it is confirmed that these examples exhibit a good heat dissipating performance (cooling performance) by heat radiation.

In contrast, in comparative examples 3, 7, and 11, thermal conductivity $\lambda$ is equal to or more than 120 W/(m·K), surface emissivity $\epsilon$ is equal to or more than 0.80, the shapes are those illustrated in FIGS. 2, 3, and 7, which are preferable, and the plate thickness is 2.0 mm, which is within the specified range from 0.8 to 6 mm. However, the total projected area of the heat dissipating surfaces of each heat sink is less than 19000 $mm^2$, which is excessively small.

As a result, although the temperature of the LED element in the steady state in each comparative example of the heat sink is equal to or lower than the allowable temperature 100° C., the measured temperature in each comparative example is higher than that of the above-described examples, and the heat resistance R of the heat sink exceeds 4.0 K/W. Thus, the heat dissipating performance (cooling performance) by heat radiation of these comparative examples is significantly degraded compared to that of the examples in a closed space such as a vehicle LED lamp in which air convection is inhibited.

Also, in comparative examples 4, 8, and 12, thermal conductivity λ is equal to or more than 120 W/(m·K) and surface emissivity ϵ is equal to or more than 0.80, the shapes are those illustrated in FIGS. 2, 3, and 7, which are preferable, and the total projected area of the heat dissipating surfaces of each of these heat sinks is equal to or more than 19000 $mm^2$, which is within the specified range. However, the plate thickness of each of these heat sinks is 0.7 mm, which is excessively thin and out of the specified range from 0.9 to 6 mm.

As a result, although the temperature of the LED element in the steady state in each comparative example of the heat sink is equal to or lower than the allowable temperature 100° C., the measured temperature in each comparative example is also higher than that of the above-described examples, and the heat resistance R of the heat sink exceeds 4.0 K/W. Thus, the heat dissipating performance (cooling performance) by heat radiation of these comparative examples is also significantly degraded compared to that of the examples in a closed space such as a vehicle LED lamp in which air convection is inhibited.

Also, comparative examples 13 and 14 of the heat sink have the shape illustrated in FIG. 14, which is not preferable. As a result, although the temperature of the LED element in the steady state in the comparative example 13 of the heat sink, the total projected area of the heat dissipating surfaces of which is excessively small and less than 19000 $mm^2$, is equal to or lower than the allowable temperature 100° C., the measured temperature in the comparative example 13 is higher than that of the above-described examples, and the heat resistance R of the heat sink exceeds 4.0 K/W. Also, although the temperature of the LED element in the steady state in the comparative example 14 of the heat sink, the total projected area of the heat dissipating surfaces of which is within the specified range of 19000 to 60000 $mm^2$, is equal to or lower than the allowable temperature 100° C., the measured temperature in the comparative example 14 is higher than that of the above-described examples, and the heat resistance R of the heat sink exceeds 4.0 K/W. Thus, the heat dissipating performance (cooling performance) by heat radiation of these comparative examples 13 and 14 is degraded in a closed space such as a vehicle LED lamp in which air convection is inhibited.

The heat sinks having shapes illustrated in FIGS. 11, 12, and 13 are actually produced with the projected area of the plate-shaped heat dissipating surfaces of each heat sink being varied. A current is applied to the LED element mounted on each heat sink so as to cause the LED element emits light in a closed space that simulates the vehicle LED lamp, and the temperature of the LED element is measured. The evaluation result of the heat dissipating performance by heat radiation of these heat sinks is shown in Table 2.

The projected area of the plate-shaped heat dissipating surfaces of each heat sink is varied only by changing the area, that is, the size (height in the Y-direction) of the rectangular plate-shaped heat dissipating surfaces 10 to 12. The base 2 of each heat sink have the same shape and size, and the base 2 and the heat dissipating surfaces 10 to 12 have a certain thickness of 2.0 mm. The heat sinks have a uniform thermal conductivity λ of 210 W/(m·K). The rectangular shape (in plan view) of the base 2 in FIGS. 11 and 13 is 100 mm (Z-direction)×100 mm (X-direction), and the base 2 illustrated in FIG. 12 has a perfect circle shape (in plan view) having a diameter of 100 mm and the common plate thickness of 2 mm.

The heat sinks illustrated in FIGS. 11 and 13 are each produced by performing a pressing process on a JIS 1050 system aluminum cold-rolled sheet so that the end portions are bent into the plate-shaped heat dissipating surfaces. The heat sink illustrated FIG. 12 is produced by drawing a JIS 1050 system aluminum cold-rolled sheet in a pressing process.

The surfaces of each heat sink are coated with a commercial cationic black resin film by performing electrodeposition. In this state, the surface emissivity is measured with a portable emissivity measuring device developed by Japan Aerospace Exploration Agency. The result at the heat dissipating surfaces of the base 2 and the plate-shaped heat dissipating surfaces 10 to 12 in each heat sink is the same value, 0.85.

TABLE 1

| No. | Type | Ref. FIG. No. | No. of fins in flat support | Fin arrangement | Thickness (mm) | Total area of heat dissipating surface ($mm^2$) | Heat resistance R | Ave. Temp. (stready state) (° C.) |
|---|---|---|---|---|---|---|---|---|
| 1 | Example | 2 | 4 on one surface only | Perpendicular | 2.0 | 19500 | 29.7 | 3.1 |
| 2 | Example | 2 | 4 on one surface only | " | 2.0 | 21600 | 28.5 | 2.7 |
| 3 | Comparative example | 2 | 4 on one surface only | " | 2.0 | 16000 | 33.2 | 4.2 |
| 4 | Comparative example | 2 | 4 on one surface only | " | 0.7 | 19240 | 33.8 | 4.4 |
| 5 | Example | 3 | Total 8 on both surfaces | Perpendicular | 2.0 | 20200 | 30.1 | 3.2 |

TABLE 1-continued

| No. | Type | Ref. FIG. No. | No. of fins in flat support | Fin arrangement | Thickness (mm) | Total area of heat dissipating surface ($mm^2$) | Heat resistance R | Ave. Temp. (stready state) (° C.) |
|---|---|---|---|---|---|---|---|---|
| 6 | Example | 3 | Total 8 on both surfaces | " | 2.0 | 24400 | 28.2 | 2.6 |
| 7 | Comparative example | 3 | Total 8 on both surfaces | " | 2.0 | 17400 | 33.2 | 4.2 |
| 8 | Comparative example | 3 | Total 8 on both surfaces | " | 0.7 | 19940 | 33.8 | 4.4 |
| 9 | Example | 7 | 4 on one surface only | Perpendicular | 2.0 | 19600 | 29.7 | 3.1 |
| 10 | Example | 7 | 4 on one surface only | " | 2.0 | 21700 | 28.5 | 2.7 |
| 11 | Comparative example | 7 | 4 on one surface only | " | 2.0 | 17450 | 33.2 | 4.2 |
| 12 | Comparative example | 7 | 4 on one surface only | " | 0.7 | 19940 | 33.8 | 4.4 |
| 13 | Comparative example | 11 | Total 8 on both surfaces | Parallel | 2.0 | 14700 | 35.7 | 5.0 |
| 14 | Comparative example | 11 | Total 8 on both surfaces | " | 2.0 | 19000 | 35.1 | 4.8 |

In each heat sink, a commercial LED element is mounted on the base, and 3.7 V, 0.85 A current (3.145 W) is applied from a Direct Current power unit so as to cause the LED element to emit light. In so doing, the heat sinks are each sealed and disposed in a wooden column-shaped body of 300×300×300 mm, which simulates a closed space for a vehicle LED lamp where air convection is inhibited while monitoring the temperature of the LED element with a thermocouple. By simulating the closed space for the vehicle LED lamp, the ambient temperature around the heat sink is set to 20° C., and in this room atmosphere, the LED element is caused to emit light. After a certain time period has passed, the temperature in a steady state, in which the temperature does not increase or decrease, is measured. The temperature is measured five times for each heat sink, and an average temperature is obtained so as to be evaluated.

As shown in Table 2, examples 21, 22, 24, and 25, which are heat sinks having preferable shapes illustrated in FIGS. 11 and 12, are formed of, as described above, aluminum having a thermal conductivity $\lambda$ of equal to or more than 120 W/(m·K) for the bases and the plate-shaped heat dissipating surfaces, and the surface emissivity $\epsilon$ of the bases and the plate-shaped heat dissipating surfaces is equal to or more than 0.65. Under the above-described conditions, the plate thickness of each of these heat sinks is 2.0 mm, which is within the specified range from 0.7 to 6 mm, and, the total projected areas P0 and P1 (in $mm^2$) or P2 and P3 (in $mm^2$) of the plate-shaped heat dissipating surfaces 10 to 12, the projected areas P0 and P1 or P2 and P3 being in two different directions, satisfy $P \geq 8 \times S$.

As a result, even in a closed space that simulates the vehicle LED lamp in which air convection is inhibited, the temperature of the LED element in the steady state is maintained at equal to or lower than 42° C., which is a very low temperature equal to or lower than 100° C. that is the temperature previously described as an example allowable temperature at or under which luminous efficiency of the LED element is not decreased. Thus, it is confirmed that these examples exhibit a good heat dissipating performance (cooling performance) by heat radiation.

In contrast, in comparative examples 23 and 26, the shapes are those illustrated in FIGS. 11 and 12, which is preferable as the heat sink, thermal conductivity 2 is equal to or more than 120 W/(m·K), surface emissivity $\epsilon$ is equal to or more than 0.65, and the plate thickness of the heat sinks is 2.0 mm, which is within the specified range from 0.7 to 6 mm. However, neither the projected area P0 nor the projected area P1 (in $mm^2$) of the plate-shaped heat dissipating surfaces of the comparative example 23 satisfy $P \geq 8 \times S$ with respect to the sectional areas S of the base, and neither the projected area P2 nor the projected area P3 (in $mm^2$) of the comparative example 26 satisfy $P \geq 8 \times S$ with respect to the sectional areas S of the base. The projected areas P0 to P3 are excessively small. Thus, it is not realized that the projected areas P of the plate-shaped heat dissipating surfaces 10 to 11, the projected areas being in two different directions, satisfy $P \geq 8 \times S$.

In comparative example 27, although the projected area P4 (in $mm^2$) of the plate-shaped heat dissipating surface 13 that faces the X-direction as illustrated in FIG. 13 satisfies $P \geq 8 \times S$, the projected area P5 (in $mm^2$) of the heat dissipating surfaces 6 and 22 that face the Z-direction does not satisfy $P \geq 8 \times S$. Thus, the heat dissipating performance by radiation from the heat dissipating surfaces in the Z-direction is insufficient. Thus, it is not realized that the projected areas P of the plate-shaped heat dissipating surface 12, the projected areas being in two different directions, satisfy $P \geq 8 \times S$.

As a result, although the temperature of the LED element in the steady state in each comparative example of the heat sink is equal to or lower than the allowable temperature 100° C., the measured temperature in each comparative example is higher than that of the above-described examples. Thus, the heat dissipating performance (cooling performance) by heat radiation is degraded in a closed space that simulates the vehicle LED lamp in which air convection is inhibited.

The series of tests are performed without consideration for heat input, which is expected when the heat sink is disposed in an actual vehicle, for example, from an engine, a heat exchanger, a variety of electrical devices, and direct sunlight. Thus, the measured temperature of the LED element is thought to be lower than that of the LED element of an LED device disposed in an actual vehicle (on-vehicle LED device). In other words, the usage environment of the LED device disposed on an actual vehicle is harsher. However, these series of tests have accuracy and repeatability sufficient for performance comparison for heat sinks, and accordingly, the performance of the examples satisfies the performance required for an actual vehicle LED device.

From the above-described facts, critical meaning of the specifications of the present invention, which includes the structure of the heat sink, thermal conductivity λ, surface emissivity ϵ, the plate thickness of the heat sink, the total projected area of heat dissipating surfaces, and heat resistance R of equal to or less than 4.0 K/W, with respect to heat dissipation efficiency mainly performed by radiation is supported. Also, meaning of specifications or the like for the preferable number and arrangement of the heat dissipating fins is supported.

As described above, with the heat sink according to the present invention, heat dissipation is mainly performed by heat radiation from the heat dissipating surfaces such as the heat dissipating side surfaces. Furthermore, with the heat sink according to the present invention, the efficiency of heat dissipation mainly performed by radiation can be significantly improved. Thus, the heat sink is optimal for a small usage space (application, installation environment) in which air convection is almost inhibited. Furthermore, the heat sink can be provided, which is formed of a minimized amount of raw material aluminum or aluminum alloy, the size and thickness of which can be reduced, which allows the freedom of design to be increased, and which is produced at a reduced cost.

fication of the heat sink can be calculated. This facilitates the design of heat sinks. This can be used in a designing method of a heat sink, with which the efficiency of heat dissipation mainly performed by radiation can be significantly improved.

What is claimed is:

1. A heat sink for light emitting diode lighting, the heat sink comprising:

a base having a front surface and a rear surface, the front and rear surfaces being heat dissipating surfaces, the front or rear surface of the base serving as a light emitting diode (LED) element attachment surface to which an LED element is attached; and a plurality of plate-shaped heat dissipating surfaces integrally and continuously formed with the LED attachment surface around the LED element, wherein the base and the plate-shaped heat dissipating surfaces are formed of aluminum or an aluminum alloy having a thermal conductivity λ of equal to or more than 120 W/(m·K), wherein a surface emissivity ϵ of the base and the plate-shaped heat dissipating surfaces is equal to or more than 0.80, and wherein, when a thickness of the base and the plate-shaped heat dissipating surfaces is in a range from 0.8 to 6 mm, a total of projected areas of the heat dissipating surfaces of the base and the plate-shaped heat dissipating surfaces in three planes perpendicular to one another in a three-dimensional space is in a range from 19000 to 60000 $mm^2$.

2. The heat sink for LED lighting according to claim 1, wherein the thermal conductivity λ of the aluminum or the aluminum alloy is equal to or more than 140 W/(m·K), wherein the surface emissivity ϵ of the base and the plate-shaped heat dissipating surfaces is equal to or more than 0.83, and wherein, when the thickness of the base and the plate-shaped heat dissipating surfaces is in a range from 0.8 to 4.0 mm, the total of the projected areas of the heat sink is in a range from 19000 to 50000 $mm^2$.

TABLE 2

| No. | Type | Ref. FIG. No. | Projected area P of plate-shaped heat dissipating surface Unit: $mm^2$ | Sectional area S of base section C Unit: $mm^2$ | P/S | Projected area P of plate-shaped heat dissipating surface Unit: $mm^2$ | Sectional area S of base section C Unit: $mm^2$ | P/S | Ave. temp. (steady state) Unit: ° C. |
|---|---|---|---|---|---|---|---|---|---|
| 21 | Example | 11 | P0: 6650 | S0: 200 | P0/S0: 33 | P1: 6650 | S1: 200 | P1/S1: 33 | 39 |
| 22 | Example | 11 | P0: 3000 | S0: 200 | P0/S0: 15 | P1: 3000 | S1: 200 | P1/S1: 15 | 41 |
| 23 | Comparative example | 11 | P0: 1150 | S0: 200 | P0/S0: 5.75 | P1: 1150 | S1: 200 | P1/S1: 5.75 | 48 |
| 24 | Example | 12 | P2: 5000 | S2: 200 | P2/S2: 25 | P3: 5000 | S3: 200 | P3/S3: 25 | 38 |
| 25 | Example | 12 | P2: 2500 | S2: 200 | P2/S2: 12.5 | P3: 2500 | S3: 200 | P3/S3: 12.5 | 41 |
| 26 | Comparative example | 12 | P2: 1200 | S2: 200 | P2/S2: 6.0 | P3: 1200 | S3: 200 | P3/S3: 6.0 | 46 |
| 27 | Comparative example | 13 | P4: 10000 | S4: 200 | P4/S4: 50 | P5: 400 | S5: 200 | P5/S5: 2 | 47 |

Thus, the heat sink can be used as a heat dissipating component for vehicle lighting fixture such as vehicle LED lamp or used for a cooling box that cools a variety of electrical devices such as an inverter.

Furthermore, by using the heat resistance R of the heat sink, the plate thickness of the base and the plate-shaped heat dissipating surfaces and the total projected area of the heat dissipating surfaces required with respect to the speci-

3. The heat sink for LED lighting according to claim 1, wherein the LED element attached to the base is of 13 watts or less power consumption, where when W denotes the power consumption of the LED element, T denotes a temperature of the LED element emitting light in a steady state, T0 denotes an ambient temperature around the heat sink, ΔT denotes a difference between the temperatures T and T0, and a heat resistance of the heat sink defined by (T−T0)/W, which is a value given by dividing the difference ΔT by the power consumption W, the heat resistance is equal to or less than 4.0 K/W.

4. The heat sink for LED lighting according to claim 1, wherein the plate-shaped heat dissipating surfaces include a plurality of flat-plate shaped heat dissipating fins, plane directions of the heat dissipating fins are different from a plane direction of the LED element attachment surface, the number of heat dissipating fins that extend so as to face the same direction as one another is equal to or less than two in an arbitrary section of the base that is perpendicular to the front or rear surface of the base.

5. The heat sink for LED lighting according to claim 1, wherein the heat sink is a heat sink for a vehicle LED lamp.

6. The heat sink for LED lighting according to claim 1, wherein the plate-shaped heat dissipating surfaces include a plurality of flat-plate shaped heat dissipating fins extending in orthogonally different directions perpendicular to a plane direction of the LED element attachment surface.

7. The heat sink for LED lighting according to claim 6, wherein the base and the plate-shaped heat dissipating surface are formed of JIS 1050 aluminum.

8. The heat sink for LED lighting according to claim 7, wherein the base and the plate-shaped heat dissipating surface are coated with a paint having a high heat dissipation ratio.

9. The heat sink for LED lighting according to claim 6, wherein the base and the plate-shaped heat dissipating surface are coated with a paint having a high heat dissipation ratio.

10. A heat sink for light emitting diode lighting, the heat sink comprising:

a base having a side surface, a light emitting diode (LED) element being attached to the base; and a plurality of plate-shaped heat dissipating surfaces integrally and continuously formed with the base so as to project from the base, wherein, for each of two of the plate-shaped heat dissipating surfaces, which two plate-shaped heat dissipating surfaces respectively extend in two different directions perpendicular to the direction of projection of the plate-shaped heat dissipating surfaces from the base, projected areas P of the respective plate-shaped heat dissipating surfaces each satisfy $P \geq 8 \times S$ with respect to a corresponding one of sections S, where P denotes a projected area, parallel to a corresponding one of the projected areas P, of a respective one of the plate-shaped heat dissipating surfaces projected by parallel light emitted perpendicular to the plate-shaped heat dissipating surface, and S denotes the corresponding one of areas of sections of the base, the sections of the base passing through a position where the LED element is attached to the base.

11. The heat sink for LED lighting according to claim 10, wherein the base and the plate-shaped heat dissipating surfaces include heat dissipating surfaces that face any direction of a three-dimensional space.

12. The heat sink for LED lighting according to claim 10, wherein the base has a quadrangle shape in plan view and the plate-shaped heat dissipating surfaces are formed on sides of the quadrangle.

13. The heat sink for LED lighting according to claim 10, wherein the base has a circular shape in plan view and the plate-shaped heat dissipating surfaces are formed at part or an entirety of a circumference of the circle so as to have a cylindrical shape.

14. The heat sink for LED lighting according to claim 10, wherein the base and the plate-shaped heat dissipating surfaces are formed of aluminum or an aluminum alloy having a thermal conductivity λ of equal to or more than 120 W/(m·K), wherein a surface emissivity ϵ of the base and the plate-shaped heat dissipating surface is equal to or more than 0.65, and wherein a thickness of the base and the plate-shaped heat dissipating surface is in a range from 0.7 to 6 mm.

15. The heat sink for LED lighting according to claim 10, wherein the plate-shaped heat dissipating surfaces project perpendicularly from the base, and wherein the two plate-shaped heat dissipating surfaces respectively extend in two orthogonally different directions perpendicular to the direction of projection of the plate-shaped heat dissipating surfaces from the base.

16. The heat sink for LED lighting according to claim 15, wherein the base and the plate-shaped heat dissipating surface are formed of JIS 1050 aluminum.

17. The heat sink for LED lighting according to claim 15, wherein the base and the plate-shaped heat dissipating surface are coated with a paint having a high heat dissipation ratio.

18. The heat sink for LED lighting according to claim 15, wherein the base and the plate-shaped heat dissipating surface are coated with a paint having a high heat dissipation ratio.

* * * * *